US006263174B1

(12) United States Patent
Fuchiwaki et al.

(10) Patent No.: US 6,263,174 B1
(45) Date of Patent: Jul. 17, 2001

(54) IMAGE FORMING APPARATUS WITH REFERENCE SIGNAL CHANGING CIRCUIT

(75) Inventors: Takashi Fuchiwaki; Nobuo Hyakutake; Mikio Kobayashi, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/454,860

(22) Filed: Dec. 7, 1999

(30) Foreign Application Priority Data

Feb. 9, 1999 (JP) ..... 11-072435

(51) Int. Cl.[7] ..... G03G 15/00

(52) U.S. Cl. ..... 399/82; 399/66; 399/83; 399/302; 399/308

(58) Field of Search ..... 399/66, 75, 76, 399/78, 82, 85, 154, 160, 204, 205, 297, 301, 302, 308, 309, 394

(56) References Cited

U.S. PATENT DOCUMENTS 5,159,390 * 10/1992 Imaizumi ..... 399/301
5,300,982 * 4/1994 Inamoto et al. ..... 399/66
5,930,571 * 7/1999 Ito ..... 399/66

FOREIGN PATENT DOCUMENTS 5-323704 12/1993 (JP) .
8-146698 6/1996 (JP) .
8-314232 11/1996 (JP) .

* cited by examiner

*Primary Examiner*—Arthur T. Grimley
*Assistant Examiner*—Hoang Ngo
(74) *Attorney, Agent, or Firm*—Oliff & Berridge, P.L.C.

(57) ABSTRACT

An image forming apparatus capable of minimizing local degradation of the image carrier and effectively preventing image defects due to resistance reduction and adhesion of release agent, without lowering productivity. The image forming apparatus includes an image making unit, having an image carrier, with plural image carrying regions, the image making unit adapted to cause the image carrying regions on the image carrier to carry images and then to transfer the images onto the sheet in a series of image making cycles, and an image making controller for controlling the image making unit according to job commands for making images. The image making controller includes a reference signal changing circuit for changing reference signal for each job, and the reference signal determines which of the image carrying regions on the image carrier should be an image writing position.

15 Claims, 30 Drawing Sheets

IMAGE FORMING APPARATUS WITH REFERENCE SIGNAL CHANGING CIRCUIT

BACKGROUND OF THE INVENTION

1. Technical Field

The present invention relates to an image forming apparatus which transfers an image formed on an image carrier onto a sheet, and more particularly to improvement effectively applied to an image forming apparatus that forms color images and duplex images.

2. Related Art

In an intermediate transfer type image forming apparatus, which is described here as an example of a conventional image forming apparatus, developing devices, one for each component color of black (Bk), yellow (Y), magenta (M) and cyan (C), are arranged around a latent image carrier such as a photosensitive drum, and a belt-like intermediate transfer member is arranged opposed to the latent image carrier, whereby unfixed toner images of these component colors formed on the latent image carrier are successively transferred onto the intermediate transfer member, on color image for each rotation of the latent image carrier, and overlapping primary transfer images on the intermediate transfer member are transferred onto a sheet, such as paper or OHP sheet, to form a desired image on the sheet (see the official gazette JP-A-5-323704 for example).

In this type of image forming apparatus, because the combined toner images transferred onto the intermediate transfer member are transferred en masse onto the sheet, there is an advantage that disturbance of an image and color misalignment that may occur during multiple transfers can be effectively prevented with out having to consider the sheet thickness, surface characteristics and transport characteristics of sheet with respect to latent image carrier.

In this kind of intermediate transfer type image forming apparatus, a known method is employed which, for accurate multiple transfers of component color images, uses a reference mark on the intermediate transfer member and aligns a series of component color images with this reference mark position (for example, JP-A-8-146698).

In order to improve productivity of the image forming apparatus described above, a method has already been proposed which provides plural image carrying regions on the intermediate transfer member and which, in a series of image making cycles up to the image transfer onto the sheet, has the intermediate transfer member carry and transfer the plural images onto the sheet according to predetermined timings determined by a timing decision means (for example, official gazette JP-A-8-314232).

This kind of intermediate transfer type image forming apparatus, however, has a technical problem that because a series of color overlapping processes (primary and secondary transfer processes) are performed at the same position at all times, the resistance of that portion of the intermediate transfer member which undergoes the color overlapping processes locally degrades, causing a significant local deterioration of the intermediate transfer member and making the transfer performance uneven.

In the type where plural image carrying regions are provided on the intermediate transfer member, in particular, the image carrying regions may not be used uniformly depending on the number of sheets and the sheet size used in each job. Normally, the first image carrying region is more frequently used than the remaining image carrying regions located behind, making local deteriorations of the first region more conspicuous.

Further, in the type where plural image carrying regions are provided on the intermediate transfer member and where a duplex mode is performed, if one of the image carrying regions is fixedly assigned to carry an image for the first side of the sheet and another region is fixedly assigned to carry an image for the second side of the sheet to improve productivity, it has been found that the region of the intermediate transfer member for carrying a second-side image is more conspicuously degraded.

This may be explained as follows.

The phenomenon in which, during the duplex mode, the surface resistance of a region of the intermediate transfer member for carrying the second-side image tends to decrease is considered due to the following reasons: (1) when paper or sheet with the first-side image already transferred thereon passes through a fixing device, the water content in the paper decreases to raise the resistivity of the paper; (2) as the resistivity of the paper increases, the transfer voltage for the second-side image must be increased to that extent from the voltage used for the transfer of the first-side image, with the result that an electric discharge between the paper and the intermediate transfer member becomes intense; and (3) the electric discharge makes the surface resistance of the intermediate transfer member more likely to decrease.

Further, during the process of transferring a second-side image, the sheet with the first-side image already fixed thereon comes to the secondary transfer section again. Normally, in the fixing device a toner release agent (for example, silicone oil) is supplied to the fixing member (e.g. fixing roll) and then in transferred to the sheet, from which it is further transferred locally onto the intermediate transfer member.

When the toner release agent is locally transferred onto the intermediate transfer member, the surface energy of that portion of the intermediate transfer member to which the release agent adheres changes, affecting the transfer performance of a toner image.

At this time because the tone release agent is not transferred to the image portion, the transfer efficiency of the non-image portion (release agent adhering portion) becomes higher than that of the image portion (release agent non-adhering portion).

In such a state, when a wide-area half-tone image is produced in a simplex mode, for example, because the transfer efficiency of a portion corresponding to the image portion in the automatic duplex mode is lower than other portion, the area corresponding to the image portion becomes a light half-tone image and the area corresponding to the non-image portion becomes a deep half-tone image. This phenomenon represents a technical problem of chronic density variation (transfer variation) leading to a possible serious image defect.

In the conventional intermediate transfer type image forming apparatus, a technique is proposed in which plural reference marks with different reflectivities and shapes are provided on the intermediate transfer member and that the reference position is changed for each series of color overlapping processes (see the official gazette JP-A-8-146698).

Although this technique of changing the reference position on the intermediate transfer member for each series of color overlapping processes may reduce the local degradation of the intermediate transfer member to some extent, it gives rise to a technical problem of a reduced productivity during the continuous printing operation. Further, in a type where plural image carrying regions are provided on the intermediate transfer member, the above technique does not give any suggestion as to how the reference position of each image carrying region can be changed.

The technical problems mentioned above are not limited to the intermediate transfer type image forming apparatus but can also occur with a direct transfer type image forming apparatus which transfers an image from a latent image carrier, such as a photosensitive belt, directly onto a sheet.

SUMMARY OF THE INVENTION

The present invention has been accomplished to solve the technical problems described above and provides an image forming apparatus capable of minimizing local degradations of the image carrier and effectively preventing image defects due to resistance reduction and release agent adhesion without lowering the productivity.

The image forming apparatus according to the present invention has an image making unit for causing image carrying regions on an image carrier to carry images and then to transfer the images onto a sheet in a series of image making cycles, and an image making controller for controlling the image making unit according tho job commands. The image making controller includes a reference signal changing circuit for changing a reference signal for each job, and the reference signal determines an image writing position on the image carrier.

More particularly, the image forming apparatus has, as shown in FIG. 1, an image making unit 1 having an image carrier 2 with plural image carrying regions G (e.g., G1, G2). The image making unit 1 is adapted to cause the image carrying regions G (G1, G2) on the image carrier 2 to carry images and then to transfer the images onto the sheet 4 in a series of image making cycles. The apparatus also has an image making controller 3 for controlling the image making unit 1 according to job commands for making images. The image making controller 3 includes a reference signal changing circuit 5 for changing the reference signal for each job, and the reference signal determines which of the image carrying regions G (G1, G2) on the image carrier should be an image writing position.

In a technical means of the above configuration, the image making unit 1 according to this invention may have an appropriate construction as long as it transfers images carried by the image carrier 2 onto the sheet 4.

The image carrier 2 may for example include, as shown in FIG. 1, an image forming and carrying body 2*a* such as photosensitive body and dielectric body on which an image is formed and carried, and an intermediate transfer body 2*b* disposed to face the image forming and carrying bond 2*a* and adapted to receive the image form the image forming and carrying body 2*a* at the first primary transfer position before transferring the image onto the sheet 4. The construction of the image carrier 2 is not limited to this but may also include the one which has only the image forming and carrying body 2*a*.

In the configuration in which the image carrier 2 includes the intermediate transfer body 2*b,* at least the intermediate transfer body 2*b* has plural image carrying regions G (G1, G2). Where the image carrier 2 has only the image forming and carrying body 2*a,* the image forming and carrying body 2*a* has plural image carrying regions G.

The number of the image forming and carrying bodies 2*a* may be one, or two or more. The image forming and carrying body 2*a* and the intermediate transfer body 2*b* may be formed in any shape, such as drum or belt. The method of forming an unfixed image may be an appropriate one, such as electro-photographic method or electrostatic transfer method.

Further, the image making unit 1 according to this invention is not limited to the one that generates a full color image, but may form multiple-color images such as two- or three-color images, or single-color images. The image making unit may also select one of these image generating modes.

Further, the reference signal changing circuit 5 is only required to change the reference signal at any selected timing other than the job execution timing.

for example, the reference signal changing circuit 5 may change the reference signal during a period from the end of each job to the stopping of the apparatus.

This may be implemented by a reference signal changing circuit 5 which, during the period from the end of each job to the stopping of the apparatus, executes a dummy cycle and, when the dummy cycle is finished, starts an image making cycle on the next job by using a reference signal corresponding to a position downstream of and closest to the dummy cycle with respect to the direction of movement of the image carrier 2.

Another example of the reference signal changing circuit 5 may be the one which changes the reference signal during a period from the start of the apparatus to the start of a job.

This may be realized by a reference signal changing circuit 5 which, during the period from the start of the apparatus to the start of the job, executes a dummy cycle and, when the dummy cycle is finished, starts an image making cycle on the job by using a reference signal corresponding to a position downstream of and closest to the dummy cycle with respect to the direction of movement of the image carrier 2.

Further, to implement this configuration, the reference signal changing circuit 5 has a reference signal generating circuit for generating plural reference signals each representing an image writing position to be set on the image carrier 2, and a reference signal selecting circuit for switching among the plural reference signals generated by the reference signal generating circuit to select one of the reference signals.

In this configuration, a reference signal generating circuit may generate a reference signal by, for example, detecting the rotation information on the drive member of the image carrier 2 by an encoder. In more concrete terms, this configuration may be realized simply by reading plural reference marks (such as light reflector and transmission hole) corresponding to all or a part of the plural image carrying regions G on the image carrier 2 to generate the reference signals.

In this case, the phrase "all or a part of the plural image carrying regions" means that the reference marks need not be assigned to all the image carrying regions G (for example, only two reference marks may be allocated to four image carrying regions and two reference signals may be changed).

An easily realized example of the reference signal selecting circuit may be the one which counts all reference signals generated during a period from the start of the apparatus to the stopping of the apparatus and, based on a count value of the reference signal, selects the reference signal for the next job.

In this case, if two reference signals are used, it is preferred that an arrangement by made to finish a job with an even-numbered count value at all times. This automatically switches the reference signal and thus eliminates the need for a troublesome control.

Further, in a case where the image making cycle causes plural images to be carried on plural image carrying regions G (G1, G2) on the image carrier 2, the image making controller 3 may, for example, select the reference signal in the following manners.

One of the methods is to use a reference signal corresponding to the first image carrying region G1 to generate an image on the first image carrying region G1 and, to generate images on the subsequent image carrying regions G2, use as reference signals timing signals produced by a timer based on the reference signal corresponding to the first image carrying region.

Another method is to use reference signals corresponding to respective image carrying regions G (G1, G2) to generate images on these image carrying regions G (G1, G2).

When forming a color image in general, component color images are transferred in an overlapping manner. Because the thickness of coloring material such as toner is larger than that of a single color image, the transfer electric field becomes greater, making the local degradation of the image carrier 2 more likely.

When generating a duplex image and more particularly when transferring a second-side image, it is necessary to increase the transfer voltage due to the dried state of the sheet 4. This will likely cause a reduction in the resistance of the image carrier 2 or result in release agent adhering to the image carrier 2, which in turn leads to image defects.

In this invention, therefore, although the reference signal changing circuit 5 may be activated in all modes, it is possible to selectively activate the reference signal changing circuit 5 for changing the reference signal under such conditions as will likely cause deterioration of the image carrier 2; for example, where the image making unit 1 has selected a mode for generating a color image, or a mode of generating a duplex image, or a mode of generating a color duplex image.

Next, the workings of the technical means described above will be explained.

In an intermediate transfer type image forming apparatus, such as shown in FIG. 1, let us take up an example case in which three job commands (job 1, job 2, and job 3) are issued.

As shown in FIGS. 1 and 2, the image making controller 3 executes, according to the reference signal S1, the image making cycles for the job 1 successively on plural image carrying regions G (G1, G2) of the image carrier 2 in the direction from G1 toward G2 in the order of the side A and side B.

Then, before proceeding to the next job 2, the reference signal changing circuit 5 of the image making controller 3 changes the reference signal from S1 to S2, which determines which of the image carrying regions G (G1, G2) on the image carrier 2 (in this example, the intermediate transfer body 2*b*) should be the image writing position.

Next, the image making controller 3 executes, according to the reference signal S2, the image making cycles for the job 2 (in this example, the intermediate transfer body 2*b*) successively on plural image carrying regions G (G1, G2) of the image carrier 2 on the direction form G2 toward G1 in the order of side B and side A.

Then, before proceeding to the next job 3, the reference signal changing circuit 5 of the image making controller 3 changes the reference signal from S2 to S1, which determines which of the image carrying regions G (G1, G2) on the image carrier 2 (in this example, the intermediate transfer body 2*b*) should be the image writing position.

After this, the image making controller 3 executes, according to the reference signal S1, the image making cycles for the job 3 successively on plural image carrying regions G (G1, G2) of the image carrier 2 in the direction from G1 toward G2 in order of side A and side B.

The subsequent jobs are carried out successively by switching between the reference signals S1 and S2.

BRIEF DESCRIPTION OF THE DRAWINGS

Preferred embodiments of the image forming apparatus according to the present invention will be described in detail based on the drawings.

DESCRIPTION OF THE PREFERRED EMBODIMENT OF THE INVENTION

The present invention will be described in detail in connection with embodiments shown in the attached drawings.

EMBODIMENT 1

Figure 1:
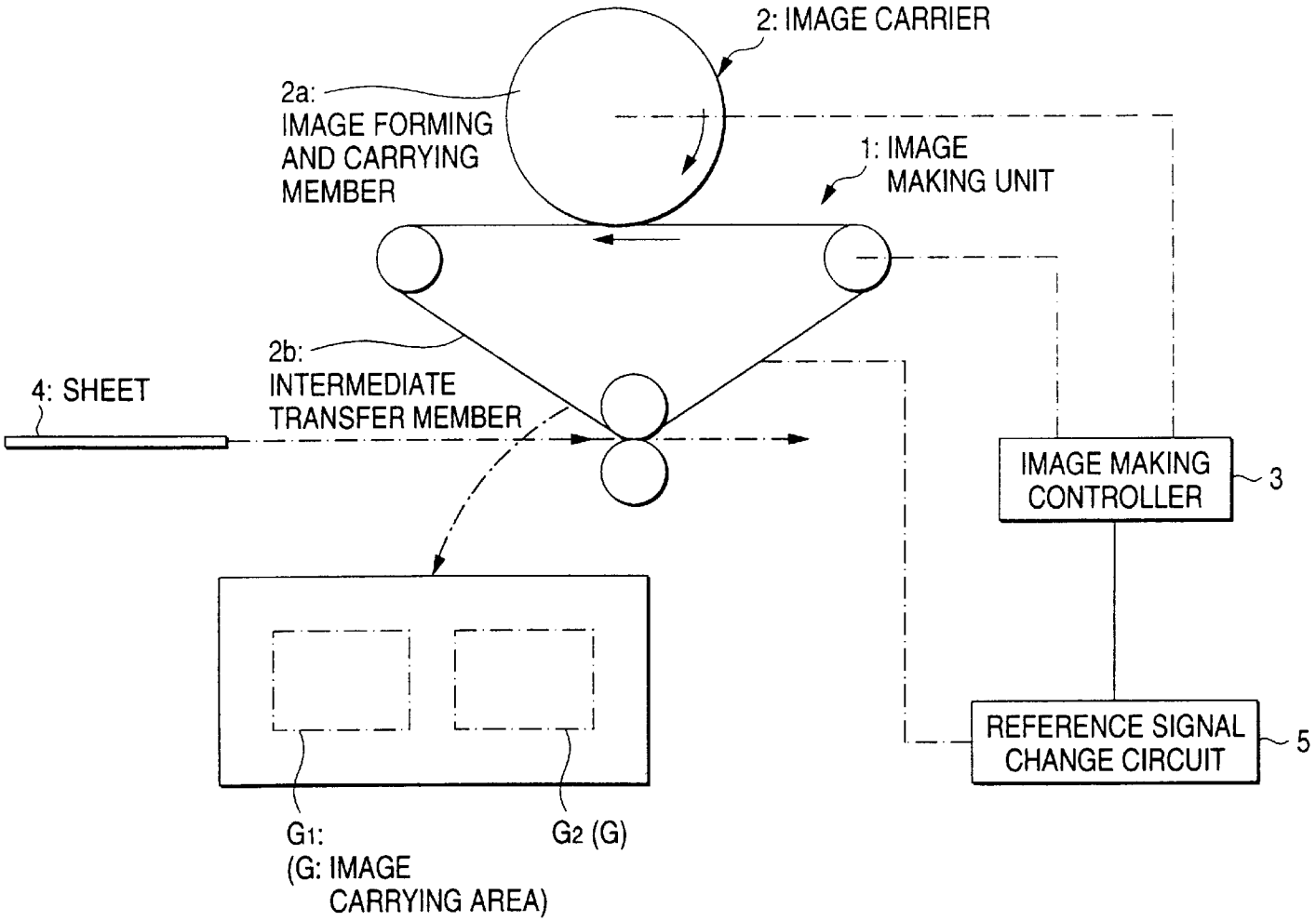
FIG. 1 is an explanatory view showing the outline of an image forming apparatus according to the invention.
Figure 2:
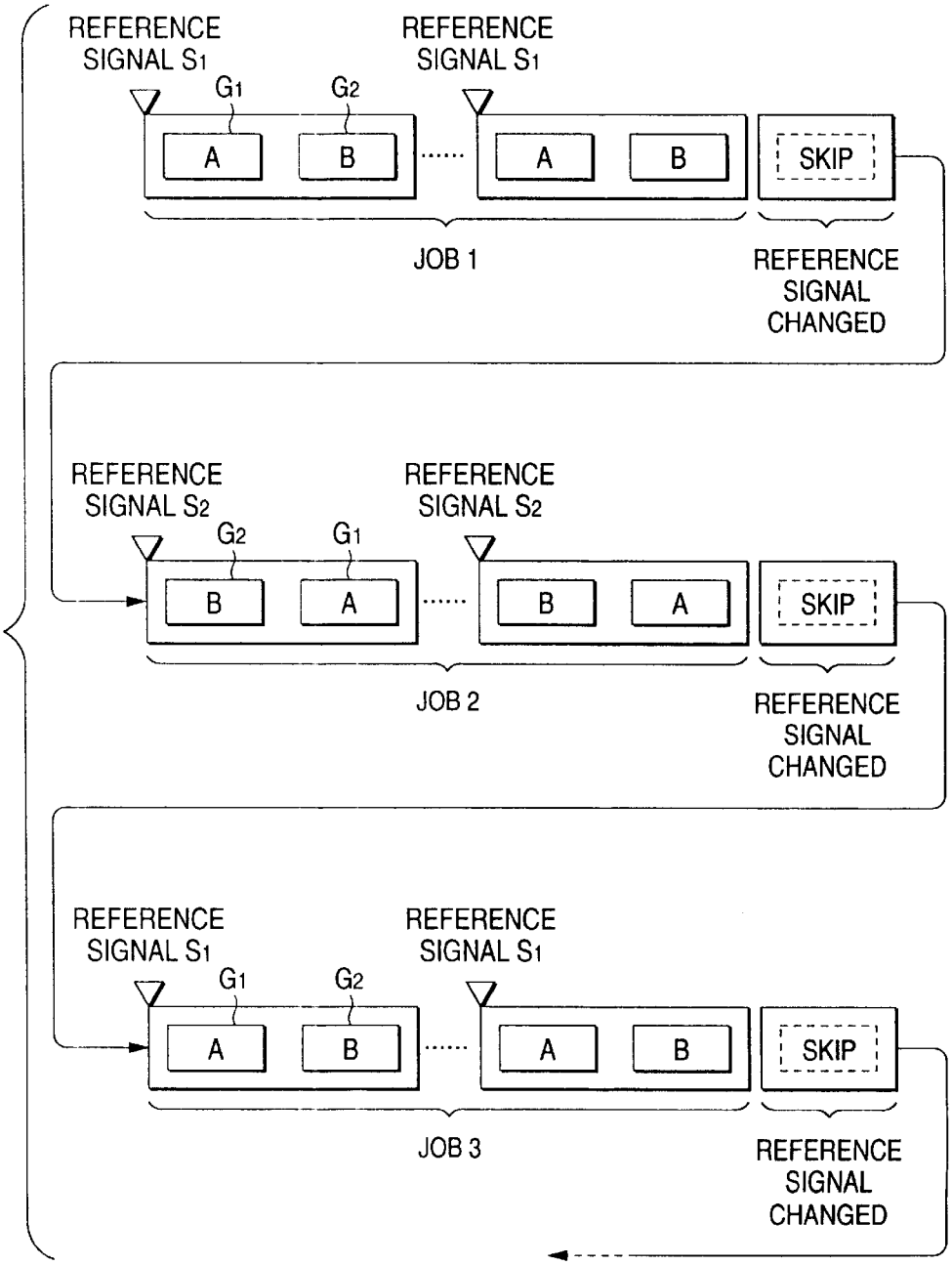
FIG. 2 is a schematic diagram showing the process of an image making device according to the invention.
Figure 3:
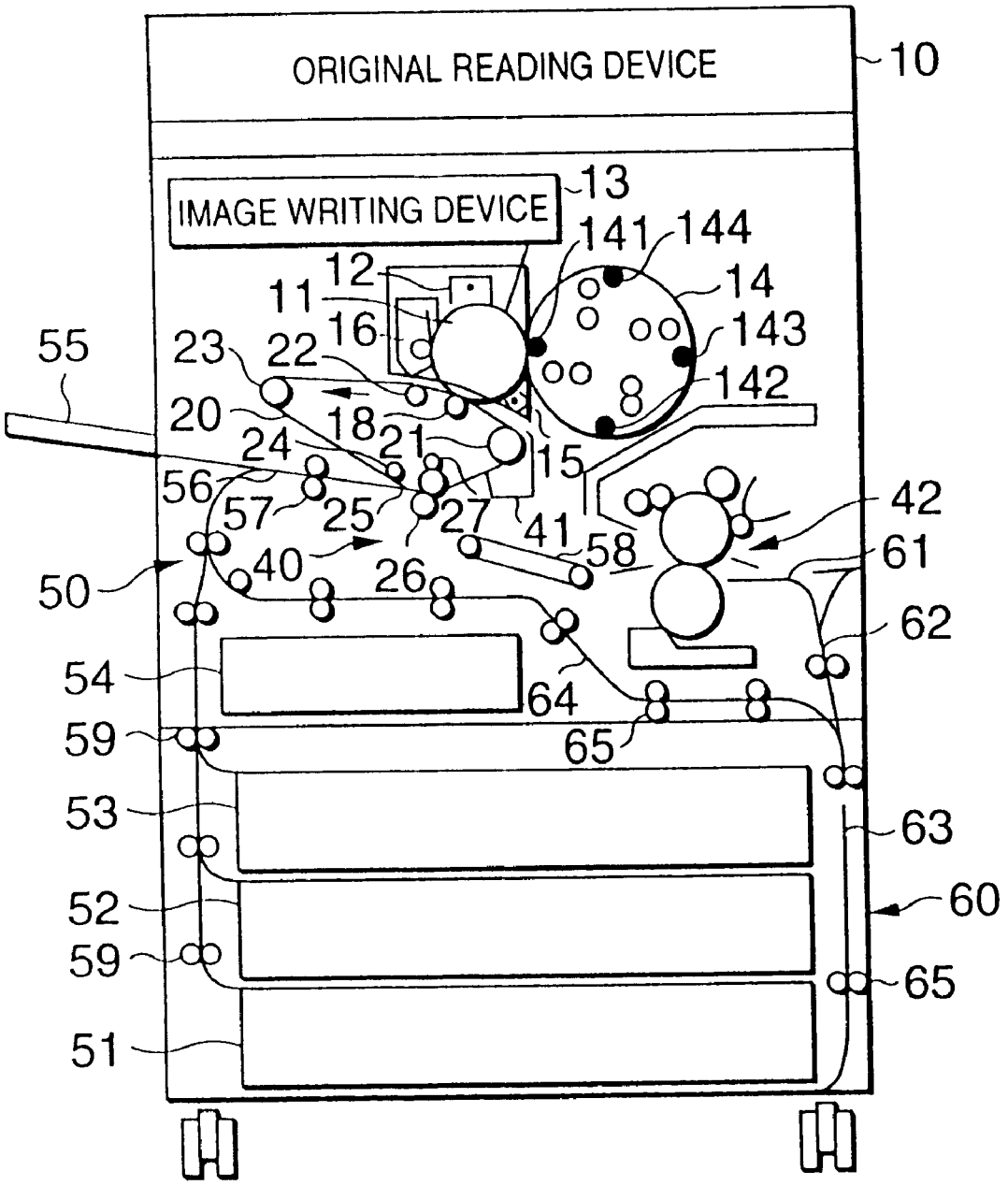
FIG. 3 is an explanatory view showing the outline of an image forming apparatus according to the embodiment 1.

FIG. 3 shows the outline configuration of an intermediate transfer type duplex image forming apparatus applying the present invention (in this embodiment, a color electrophotographic copying machine).

In the figure, reference number 10 represents an original reading device that reads an original as images of component colors, yellow (Y), magenta (M), cyan (C) and black (K). Denoted 11 is a photosensitive drum (latent image carrier) that rotates in a direction of an arrow. Designated 12 is a charger such as corotron that precharges the photosensitive drum 11. Reference number 13 is an image writing device, such as laser scanning device, that writes images from the original reading device 10 or other images on the photosensitive drum 11 as electrostatic latent images. Designated 14 is a rotary type developing device mounted with developers 141–144 corresponding to the component colors, yellow (Y), magenta (M), cyan (C) and black (K). The developing device develops electrostatic latent images formed on the photosensitive drum 11 by the corresponding developers 141–144 to form component color toner images. Reference number 15 is a pre-transfer charger such as corotron that aligns polarities of the toner images on the photosensitive drum 11. Reference number 16 is a drum cleaner that removes a residual toner from the photosensitive drum 11.

Denoted 20 is an intermediate transfer belt which is arranged in contact with the surface of the photosensitive drum 11, held in tension around plural rolls 21–25 (in this embodiment five rolls) and rotated in the direction of arrow.

In this embodiment, denoted 21 is a drive roll for the intermediate transfer belt 20; 22 and 24 are follower rolls; 23 is a tension roll to control the tension of the intermediate transfer belt 20 constant; and 25 is an opposed roll (backup roll) for a secondary transfer.

Further, in this embodiment the intermediate transfer belt 20 is formed to have a surface resistivity of $10^6$–$10^{14}\Omega/\square$ by mixing an appropriate amount of carbon black in resin or rubber, such as polyimide, polycarbonate, polyester, polypropylene and polyethylene terephthalate. The belt thickness is set, for example, to 0.1 mm.

Further, at a location on the intermediate transfer belt 20 facing the photosensitive drum 11 (at a primary transfer position) a primary transfer device 18 (in this embodiment, a transfer roll) is arranged on the back side of the intermediate transfer belt 20. By applying the transfer roll 18 with a voltage of a polarity opposite to the polarity of the charged toner, a toner image T on the photosensitive drum 11 is electrostatically attracted to the intermediate transfer belt 20.

Further, at a secondary transfer position on the intermediate transfer belt 20 facing the transport path of paper or sheet (not shown) a secondary transfer device 40 is installed. In this embodiment the secondary transfer device 40 comprises a secondary transfer roll 26 pressed under pressure against the toner image carrying surface side of the intermediate transfer belt 20 and an opposed roll (backup roll) 25 arranged on the back side of the intermediate transfer belt 20 to work as an opposing electrode for the secondary transfer roll 26.

In this embodiment, the secondary transfer roll 26 is grounded, and the backup roll 25 is stably applied with a bias of the same polarity as that of the toner through an electric feeder roll 27.

Reference number 41 is a belt cleaner for removing a residual toner adhering to the intermediate transfer belt 20.

In this embodiment, a paper feeding system 50 works as follows. Paper is transported from a predetermined number of paper trays 51–54 (in this embodiment, four trays) or a hand feed tray 55 into a paper feed path 56, in which the paper is temporarily positioned and stopped by registration rolls 57 (register rolls) 57, after which the paper is further transported to the secondary transport position at a predetermined timing and then to a transport belt 58 which in turn carries the paper onto a fixing device 42. The paper feed path 56 is provided with an appropriate number of paired transport rolls 59.

In this embodiment, there is a paper return mechanism 60 that, when the duplex mode is selected, turns over the paper, one surface of which has already been fixed by the fixing device 42, and returns the inverted paper to the secondary transfer position again.

The paper return mechanism 60, as shown in FIG. 3, has a paper branch path 62 which branches downwardly from a paper discharge path 61 from the fixing device 42. The paper branch path 62 is provided with a paper reverse path 63 extending further downwardly which in turn is connected with a paper return path 64 that goes back to the paper feed path 56 in front of the secondary transfer position.

The paper branch path 62, the paper reverse path 63 and the paper return path 64 are provided with an appropriate number of paired transport rolls 65. The paired transport rolls 65 in the paper reverse path 63 can rotate forwardly or backwardly at an appropriate timing.

Between the paper discharge path 61 and the paper branch path 62 and between the paper branch path 62, the paper reverse path 63 and the paper return path 64 there are provided paper switching gates (not shown) that select a desired paper path according to the mode selected.

Figure 4:
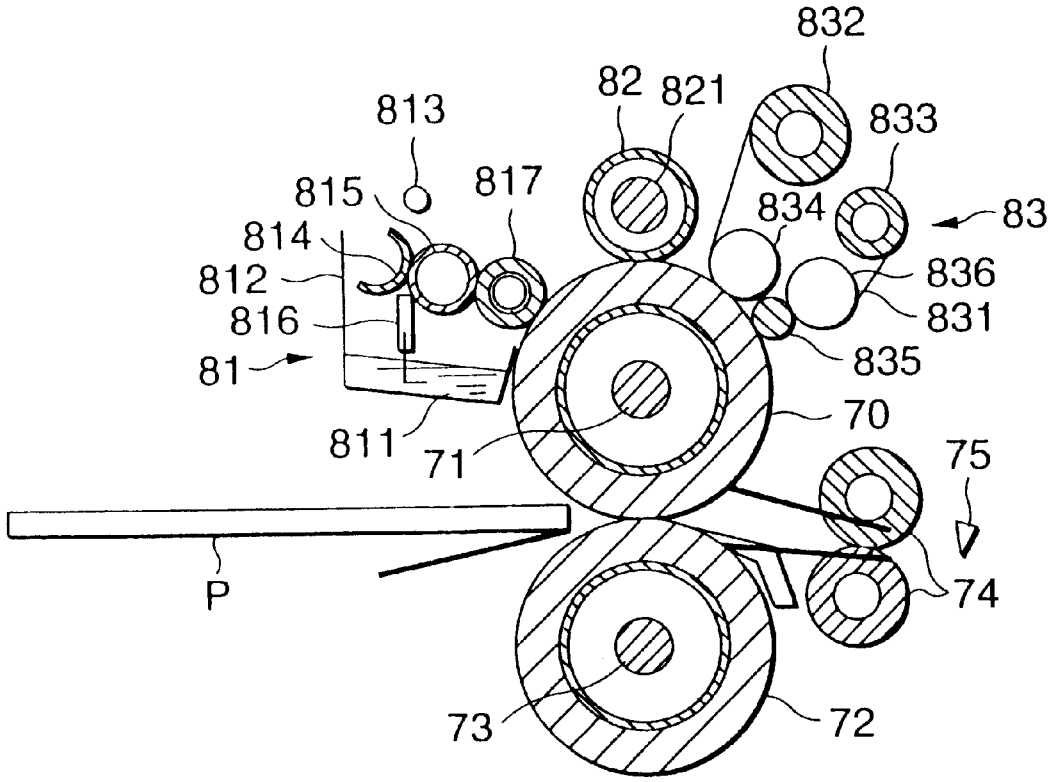
FIG. 4 is an explanatory view showing the detail of a fixing device used in the embodiment 1.

Further, in this embodiment as shown in FIG. 4, the fixing device 42 has a heating fixing roll 70 incorporating a heater 71 and a pressurizing fixing roll 72 incorporating a heater 73 which is pressed against the heating fixing roll 70 in a predetermined nipping area. On the outlet side of the nipping area of the fixing rolls 70, 72 a pair of outlet rolls 74 are arranged. Immediately behind the outlet rolls 74 an outlet sensor 75 is installed to detect when the paper P passes through the outlet rolls.

In this embodiment, the heating fixing roll 70 and the pressurizing fixing roll 72 are each made of a hollow roll body with a predetermined outer diameter (for example, 65 ϕ mm) which has an aluminum hollow roll core (4.5 mm thick for example). On the roll core a base layer such as silicone rubber is formed (e.g., to a thickness of 3 mm for the heating fixing roll 70 and 2 mm for the pressurizing fixing roll 72). The surface of this base layer is formed with a surface layer of, for instance, Viton.

Arranged around the heating fixing roll 70 on the upstream side of the nipping area of the fixing rolls 70, 72 are an oil supply device 81, an external heating roll 82 and a web cleaning device 83 in the order.

In this embodiment, the oil supply device 81 has an oil (e.g., amine-modified silicone oil as described below) 811 as a toner release agent contained in an oil pan 812, and the oil 811 in the oil pan 812 is soaked through an oil pipe 813 into a wick 814, which is placed in contact with a pickup roll 815. The pickup roll 815 is in turn brought into contact with a metering blade 816 for restricting the amount of oil on the surface of the pickup roll 815. Between the pickup roll 815 and the heating fixing roll 70 is interposed a donor roll 817 which supplies a constant amount of oil to the heating fixing roll 70.

The toner release agent used in this embodiment includes as an effective component organopolysiloxanes with a viscosity of 10–100,000 cs at 25° C. which has functional group and is expressed by the following general expression (I):

[Chemical Expression 1]

where A denotes $—R^1—X$ or $—R^1—O—Y_f—H$ [$R^1$ alkyl group with a carbon number to 1 to 8, X is $—NH_2$ or $—NHR^2NH_2$ ($R^2$ denotes alkyl group with a carbon number of 1 to 8), Y is alkyl group with a carbon number of 2 to 4, and f is an integer of 0 to 10], b and c are $0 \leqq b \leqq 10$ and $10 \leqq c \leqq 1{,}000$ and not zero simultaneously, d is 2 or 3, e is 0 or 1, d+e=3.

The external heating roll 82 incorporates a heater 821 and uses a metal with low releasability (low toner releasability), which includes, for example, stainless steel material and a metal formed with alumite, both effective in avoiding corrosion.

The external heating roll 82 can be brought into or out of contact with the heating fixing roll 70. During the warm-up, for example, it contacts the heating fixing roll 70 to enhance the surface heating efficiency of the heating fixing roll 70.

The web cleaning device 83 has a web 831 containing only a small amount of fibers and capable of being wound up. The web 831 is fed out from a web supply roll 832 and recovered onto a web recovery roll 833.

In this embodiment, the web cleaning device 83 has a first pressure roll 834 arranged on the back of the web 831 at a position where it contacts the heating fixing roll 70. The first pressure roll 834 presses the web 831 against the heating fixing roll 70 over a predetermined nipping width. A cleaning roll 835 is interposed between the heating fixing roll 70 and the outer surface of the web 831, and a second pressure roll 836 is arranged on the back side of the web 831 at a position where it contacts the cleaning roll 835. The second pressure roll 836 presses the cleaning roll 835 against the heating fixing roll 70 over a predetermined nipping width.

Figure 5:
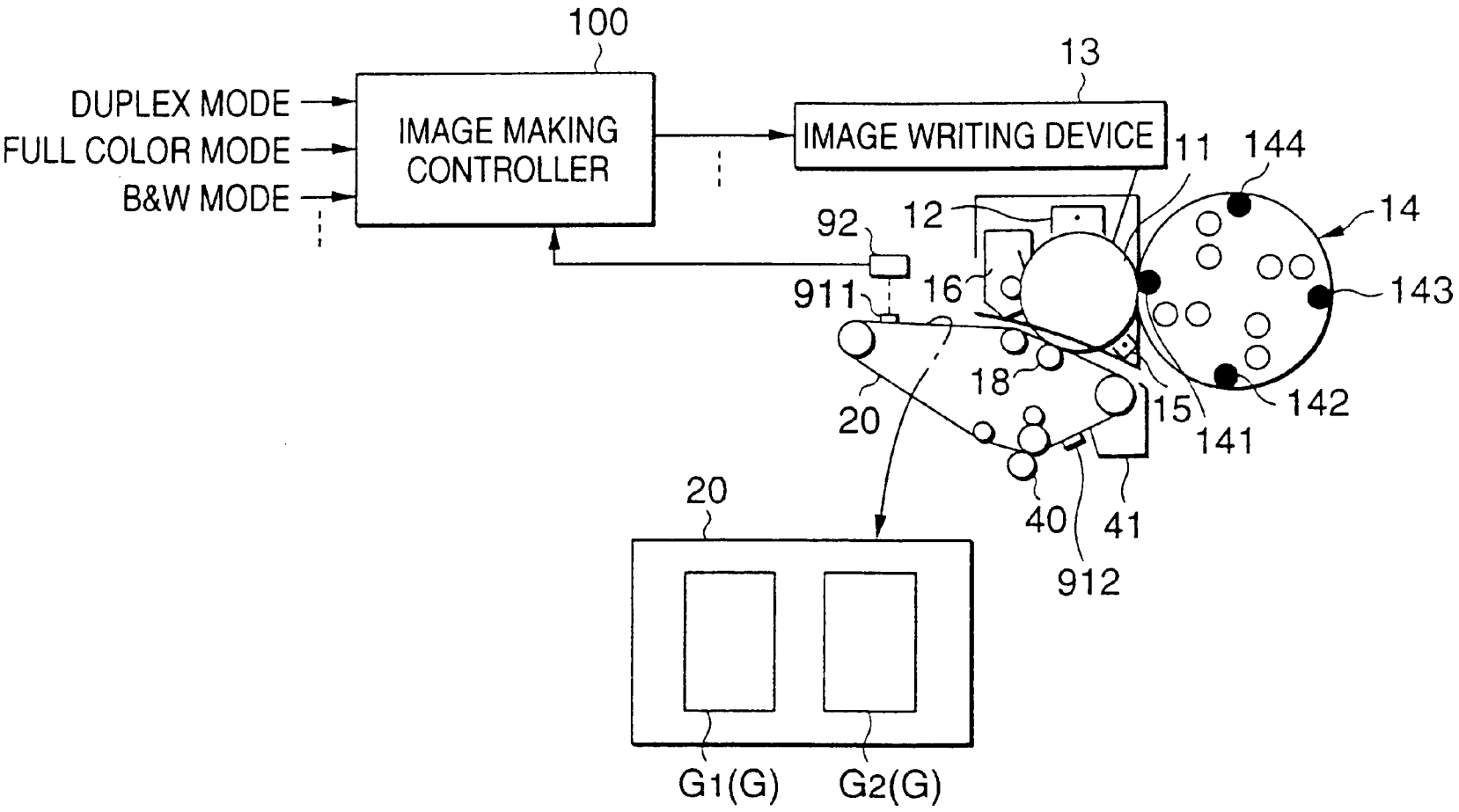
FIG. 5 is a block diagram showing an image making control system used in the embodiment 1.

In this embodiment, the intermediate transfer belt 20, as shown in FIG. 5, has plural image carrying regions G (in this embodiment, two regions G1 and G2) of, for example, JIS A4 size. In a part of other than the image carrying regions G (G1, G2) of the intermediate transfer belt 20, two reference signal generation marks 911, 912 are formed at two different points separated by the half rotation of the intermediate transfer belt 20. A mark sensor 92 is located at a predetermined position facing the locus of the reference marks 911, 912 and spaced from the intermediate transfer belt 20.

A light reflecting object with high reflectivity and a hole for passing light may be used as the reference marks 911, 912.

Further in this embodiment, an image making controller 100 comprises, for example, a microcomputer system (CPU, ROM, RAM, I/O port, etc.) and, as shown in FIG. 5, takes in through an I/O port signals from a variety of mode selection switches for duplex mode, full color mode, B&W (black and white) mode and others and a detection signal from the mark sensor 92 and sends them to the CPU. In response to these signals, the CPU executes an image making program (including a reference signal change program [see FIG. 6]) stored in the ROM and sends out predetermined control signals through the I/O port to the photosensitive drum 11, image writing device 13, other image making devices, intermediate transfer belt 20, fixing device 42, paper feeding system 50, etc.

Next, the operation of the intermediate transfer type image forming apparatus according to this embodiment will be explained.

Full Color Simplex Mode

Figure 7:
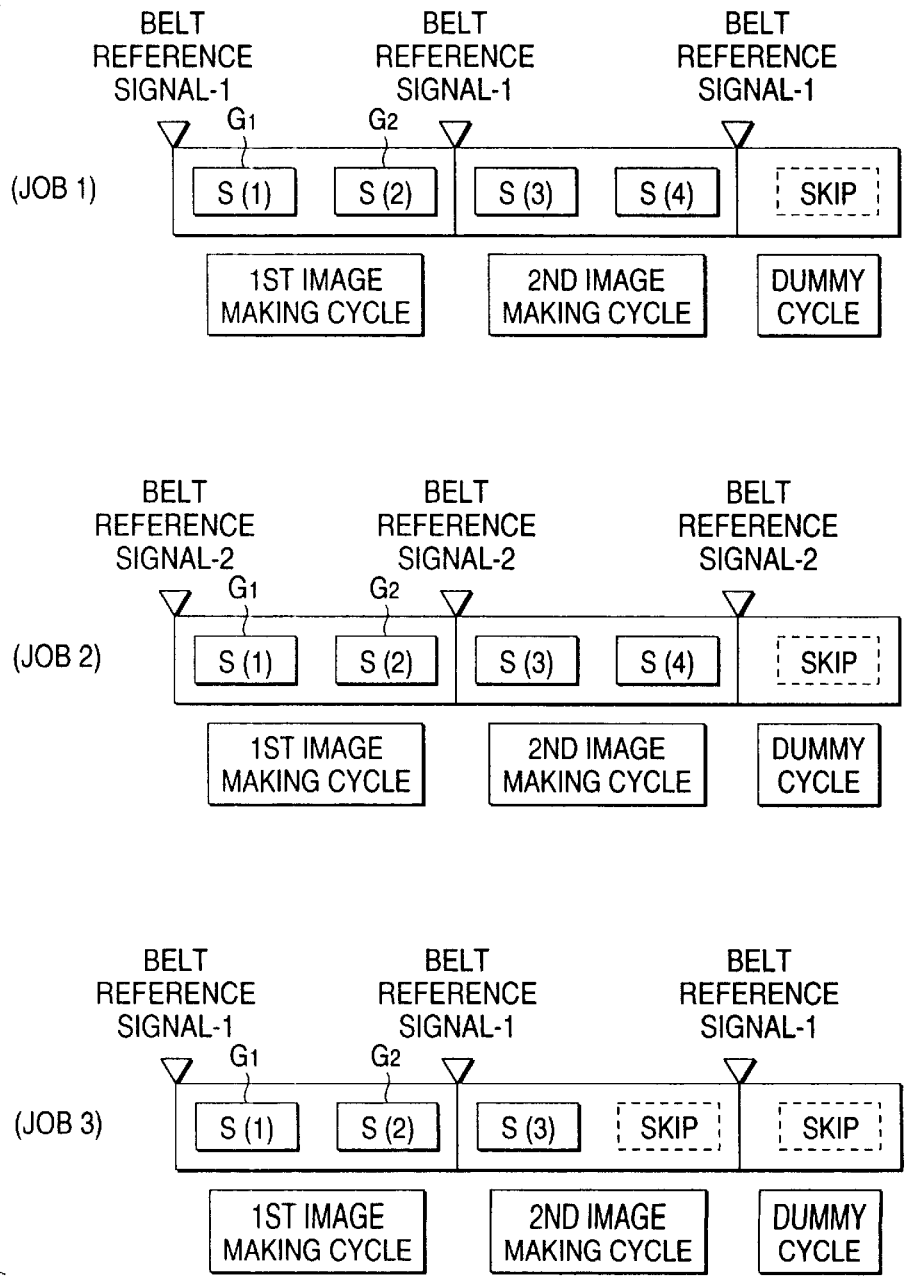
FIG. 7 is a schematic diagram showing a process covering plural jobs (simplex mode) according to the embodiment 1.

Described in the following is an example case where three job commands (job 1, job 2, job 3) for the full color simplex mode are instructed, as shown in FIG. 7.

Figure 8:
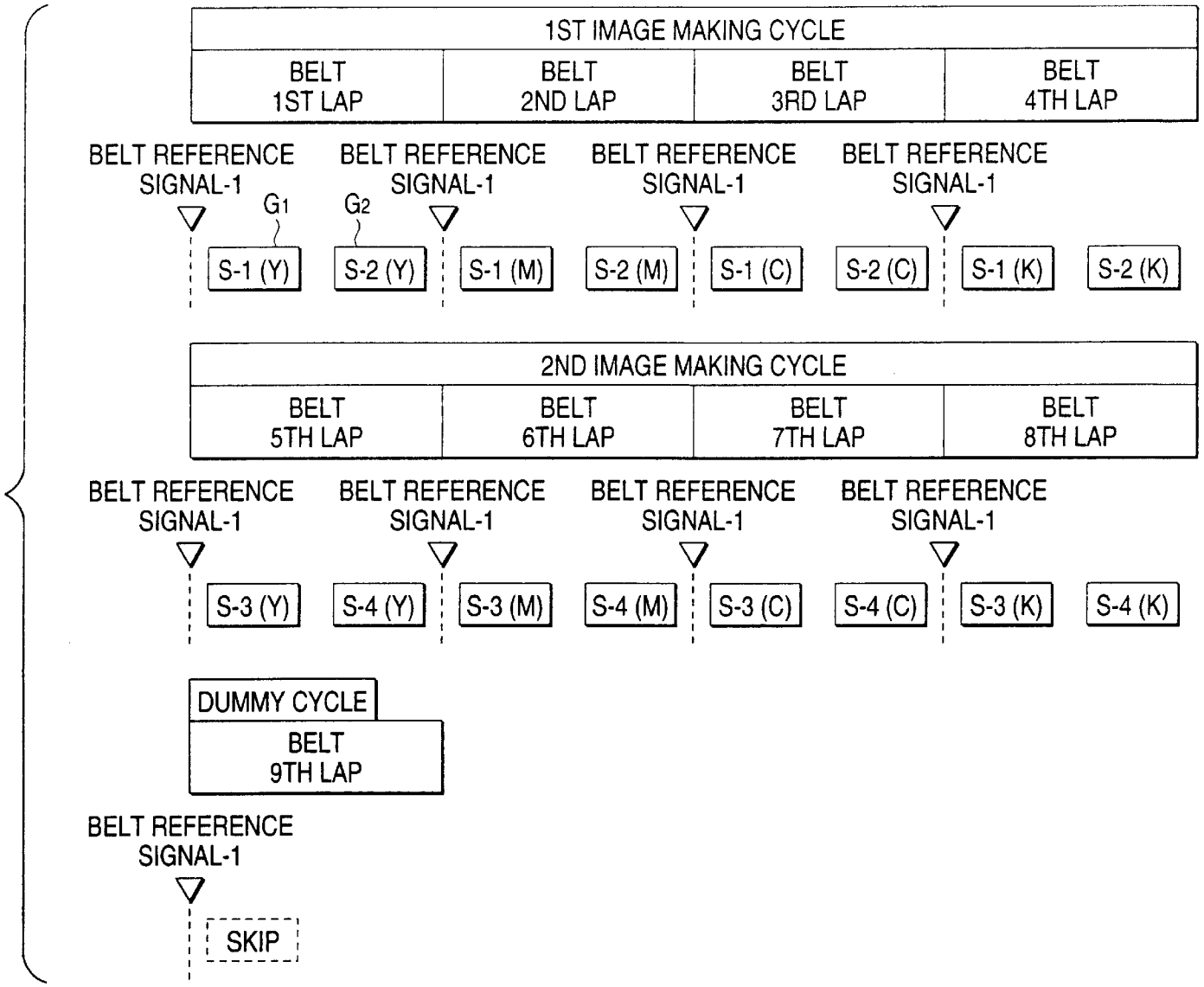
FIG. 8 is a schematic diagram showing the detail of a process of the job 1 in FIG. 7.
Figure 9:
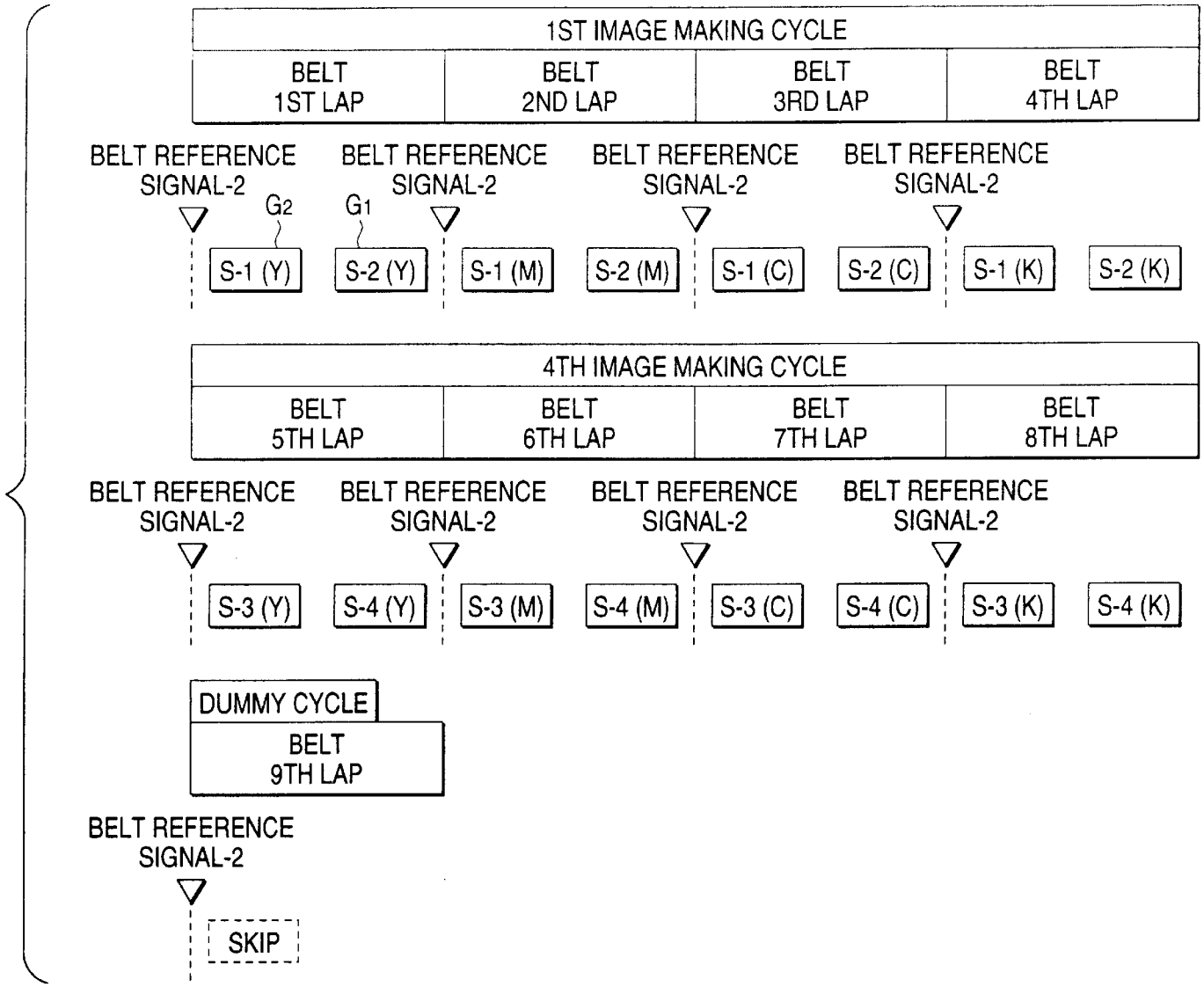
FIG. 9 is a schematic diagram showing the detail of a process of the job 2 in FIG. 7.
Figure 10:
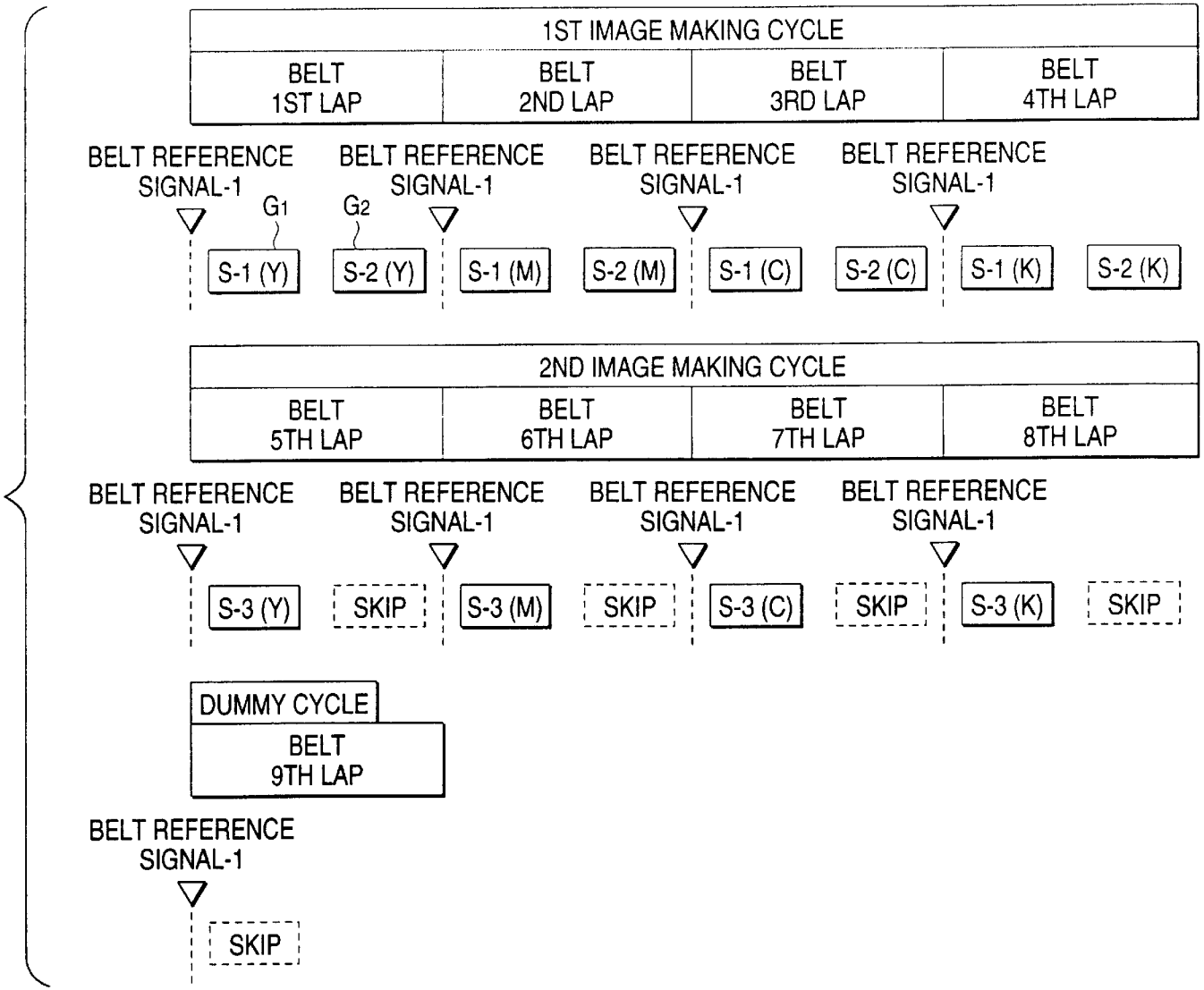
FIG. 10 is a schematic diagram showing the detail of a process of the job 3 in FIG. 7.

The job 1 and job 2 shown in FIG. 7 are to make four simplex prints as shown in FIGS. 8 and 9. The job 3 in FIG. 7 is to make three simplex prints as shown in FIG. 10. As to the job 1, it is assumed that belt reference signal-1 has been selected. FIGS. 8 to 10 show only the images to be formed in each rotation of the intermediate transfer belt 20 in each image making cycle and omit those images already formed in the image making cycles.

Suppose a job command associated with the job 1 is entered into the image making controller 100. In the first image making cycle (first lap to fourth lap of the intermediate transfer belt), at each rotation of the intermediate transfer belt 20 the image making controller 100 transfers an image S-1 for the first sheet (in more concrete terms, component color images of yellow, magenta, cyan and black S-1(Y), S-1(M), S-1(C), S-1(K)) onto the first image carrying region G1 on a front part of the intermediate transfer belt 20 according to the belt reference signal-1 and also transfers an image S-2 for the second sheet (more specifically, component color images of yellow, magenta, cyan and black S-2(Y), S-2(M), S-2(C), S-2(K)) onto the subsequent second image carrying region G2.

As a reference signal for writing images onto the second image carrying region G2, this embodiment uses a timing signal which is output a predetermined time after the preceding reference signal for the first image carrying region G1 (belt reference signal-1 which is a reference signal from the mark sensor 92 associated with the first reference mark 911) by a timer that is triggered by the belt reference signal-1.

Hence, the writing of images onto the second image carrying region G2 is precisely controlled by the timing signal based on the belt reference signal-1.

When the intermediate transfer belt 20 has rotated four times, the first and second image carrying regions G1, G2 on the intermediate transfer belt 20 carry the images S-1, S-2 for the first and second sheets (multiple transfer images each consisting of component color images) and then transfer these images onto one side (first side) of the first and second sheets, respectively, thus completing the first image making cycle.

Then, after the sheets with their images transferred thereon undergo the fixing process in the fixing device 42, they are discharged through the paper discharge path 61 onto a discharge tray not shown.

Next, in the second image making cycle (fifth lap to eighth lap of the intermediate transfer belt), at each rotation of the intermediate transfer belt 20 the image making controller 100 transfers an image S-3 for the third sheet (more specifically, component color images of yellow, magenta, cyan and black S-3(Y), S-3(M), S-3(C), S-3(K)) onto the first image carrying region G1 on the front part of the intermediate transfer belt 20 according to the belt reference signal-1 and then transfer an image S-4 for the fourth sheet (more specifically, component color images of yellow, magenta, cyan and black S-4(Y), S-4(M), S-4(C), S-4(K)) onto the subsequent second image carrying region G2 according to a timing signal based on the belt reference signal-1.

When the intermediate transfer belt 20 has rotated four times, the first image carrying region G1 on the intermediate transfer belt 20 carries the image S-3 for the third sheet (a multiple transfer image consisting of component color images) and the second image carrying region G2 carries the image S-4 for the fourth sheet (multiple transfer image consisting of component color images). At the secondary transfer position, the two images on the intermediate transfer belt 20 are transferred onto one side (first side) of the third and fourth sheets, respectively, thus completing the second image making cycle.

Then, after the two sheets with their images successively transferred thereon undergo the fixing process in the fixing device 42, they are discharged through the paper discharge path S1 onto a discharge tray not shown.

Figure 6:
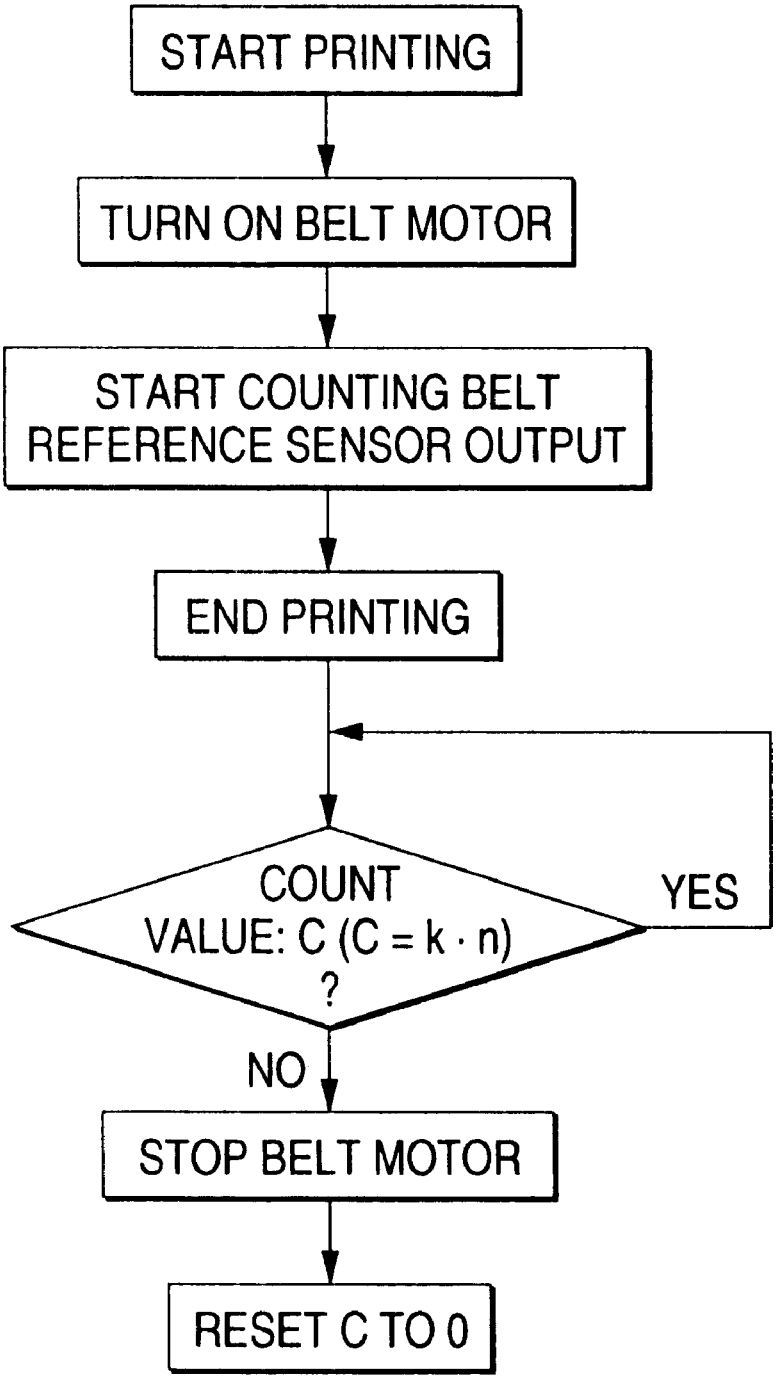
FIG. 6 is a flow chart showing a process of changing a reference signal according to the embodiment 1.

In this stage, the image making cycle on the job 1 is completed and, before proceeding to the job 2, the image making controller 100 performs a reference signal change processing shown in FIG. 6.

That is, in this embodiment when a belt motor (not shown) is turned on at the print start, the image making controller 100 starts counting up the output of the mark sensor (belt reference sensor) 92. When the printing is ended, the controller checks if the count C of the mark sensor 92 is equal to k·n (k is a constant [k=2 because in this example two sides are switched], and n is a natural number). If the count C is not k·n, the controller stops the belt motor (not shown) and resets the count value.

In this embodiment, by the time a series of image making cycles are completed, the intermediate transfer belt 20 has made eight rounds, so the count C at this point in time is even-numbered. Hence, the image making controller 100, as shown in FIGS. 7 and 8, performs a dummy cycle (a first half of the ninth lap of the intermediate transfer belt) in which the intermediate transfer belt 20 is rotated through a half turn to skip the first image carrying region G1 and thereby count up the detection signal from the mark sensor 92 by one. In this condition, the controller stops the belt motor (not shown).

In this state, the belt reference signal is switched from the belt reference signal-1 to a belt reference signal-2 (a reference signal based on a detection signal from the mark sensor 92 associated with the second reference mark 912).

After this, the image making controller 100 executes a job command associated with the job 2 as shown in FIG. 9.

In the first image making cycle (first lap to fourth lap of the intermediate transfer belt, at each rotation of the intermediate transfer belt 20 the image making controller 100 transfers an image S-1 for the first sheet (more specifically, component color images of yellow, magenta, cyan and black S-1(Y), S-1(M), S-1(C), S-1(K)) onto the second image carrying region G2 on a front part of the intermediate transfer belt 20 according to the belt reference signal-2 and also transfer an image S-2 for the second sheet (more specifically, component color images of yellow, magenta, cyan and black S-2(Y), S-2(M), S-2(C), S-2(K)) onto the subsequent first image carrying region G1.

As a reference signal for writing images onto the first image carrying region G1, this embodiment uses a timing signal which is output a predetermined time after the preceding reference signal for the second image carrying region G2 (belt reference signal-2) by a timer that is triggered by the belt reference signal-2.

When the intermediate transfer belt 20 has rotated four times, the second and first image carrying regions G2, G1 on the intermediate transfer belt 20 carry the images S-1, S-2 for the first and second sheets (multiple transfer images each consisting of component color images) and then transfer these images onto one side (first side) of the first and second sheets, respectively, thus completing the first image making cycle.

Then, after the sheets with their images transferred thereon undergo the fixing process in the fixing device 42, they are discharged though the paper discharge path 61 onto a discharge tray not shown.

Next, in the second image making cycle (fifth lap to eighth lap of the intermediate transfer belt), at each rotation of the intermediate transfer belt 20 the image making controller 100 transfers an image S-3 for the third sheet (more specifically, component color images of yellow, magenta, cyan and black S-3(Y), S-3(M), S-3(C), S-3(K)) onto the second image carrying region G2 on the front part of the intermediate transfer belt 20 according to the belt reference signal-2 and then transfers an image S-4 for the fourth sheet (more specifically, component color images of yellow, magenta, cyan and black S-4(Y), S-4(M), S-4(C), S-4(K)) onto the subsequent first image carrying region G1 according to a timing signal based on the belt reference signal-2.

When the intermediate transfer belt 20 has rotated four times, the second image carrying region G2 on the intermediate transfer belt 20 carries the image S-3 for the third sheet (a multiple transfer image consisting of component color images) and the first image carrying region G1 carries the image S-4 for the fourth sheet (a multiple transfer image consisting of component color images). At the secondary transfer position, the two images on the intermediate transfer belt 20 are transferred onto one side (first side) of the third and fourth sheets, respectively, thus completing the second image making cycle.

Then, after the two sheets with their images successively transferred thereon undergo the fixing process in the fixing device 42, they are discharged through the paper discharge path 61 onto a discharge tray not shown.

In this stage, the image making cycle on the job 2 is completed and the image making controller 100 performs the reference signal change processing shown in FIG. 6 to switch the belt reference signal from the belt reference signal-2 to the belt reference signal-1, before executing the job commands for the job 3.

After the image making cycles on the job 3 are finished, the image making controller 100 performs the reference signal change processing and stops the operation of the apparatus.

Full Color Duplex Mode

Next, we will describe an example case where two job commands (job 1, job 2) for the full color duplex mode are instructed.

Figure 11:
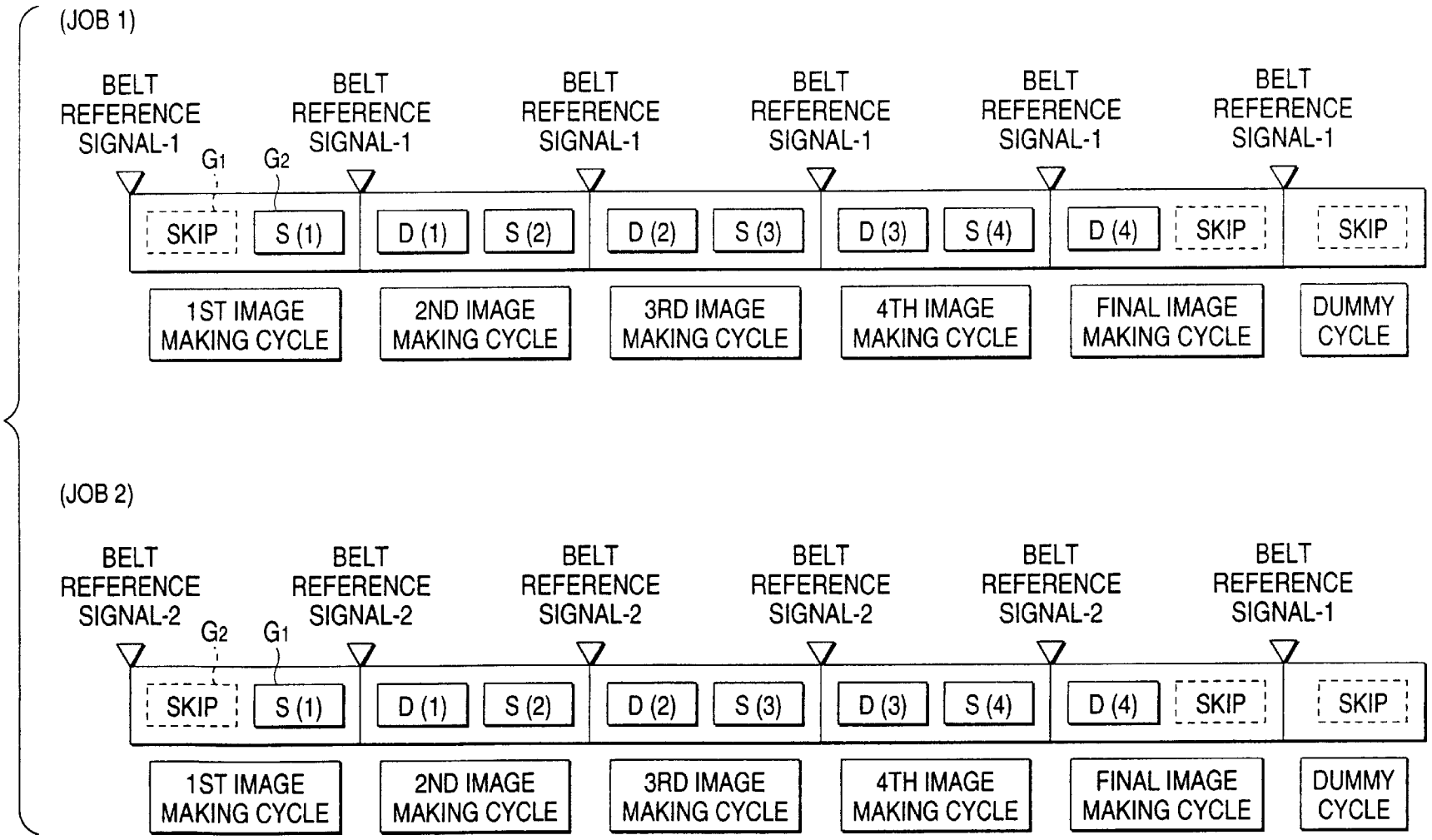
FIG. 11 is a schematic diagram showing a process covering plural jobs (duplex mode) according to the embodiment 1.
Figure 12:
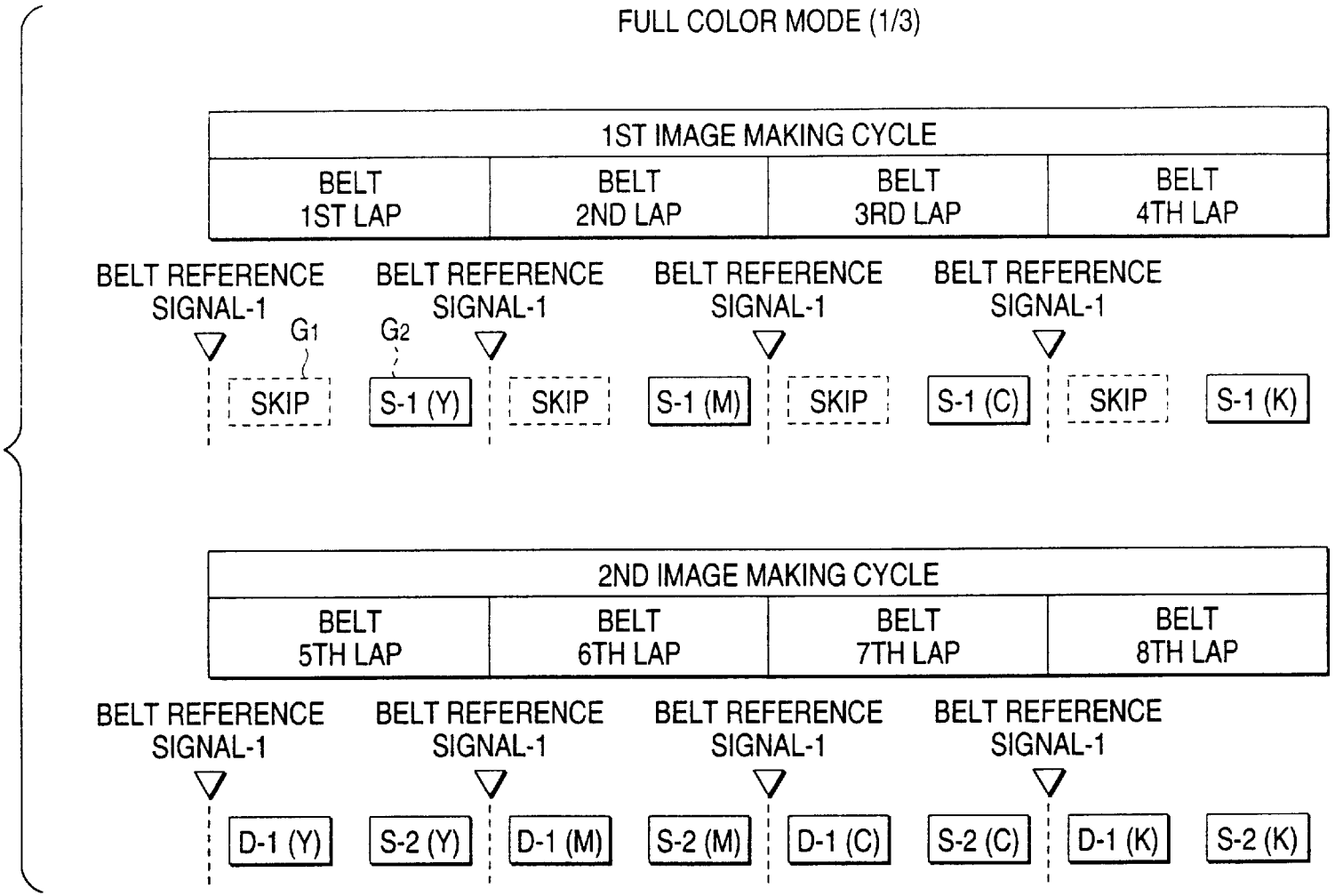
FIG. 12 is an explanatory diagram showing a first ⅓ of a process of a full color mode used in the job 1 of FIG. 11.
Figure 13:
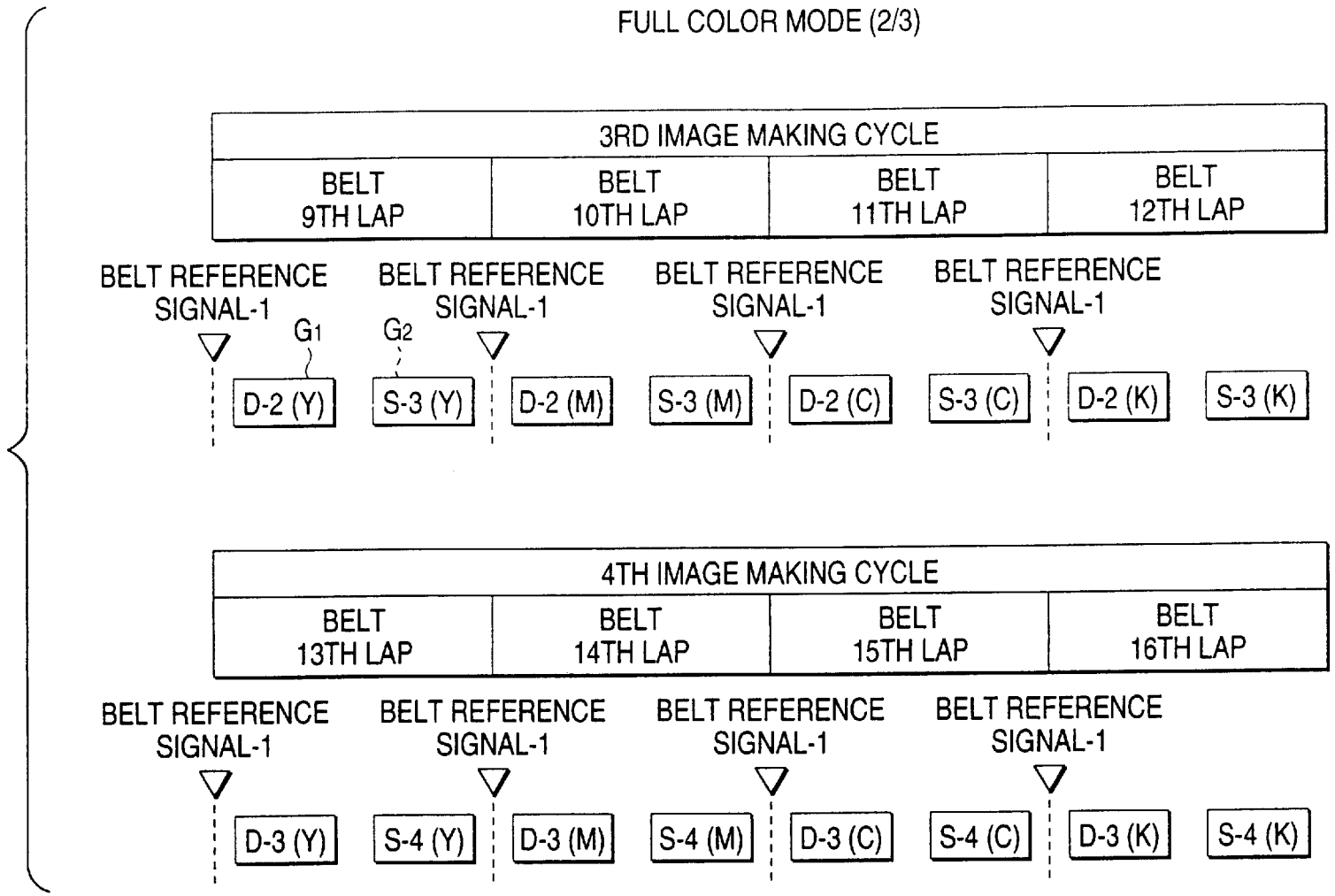
FIG. 13 is an explanatory diagram showing a second ⅓ of a process of a gull color mode used in the job 1 of FIG. 11.
Figure 14:
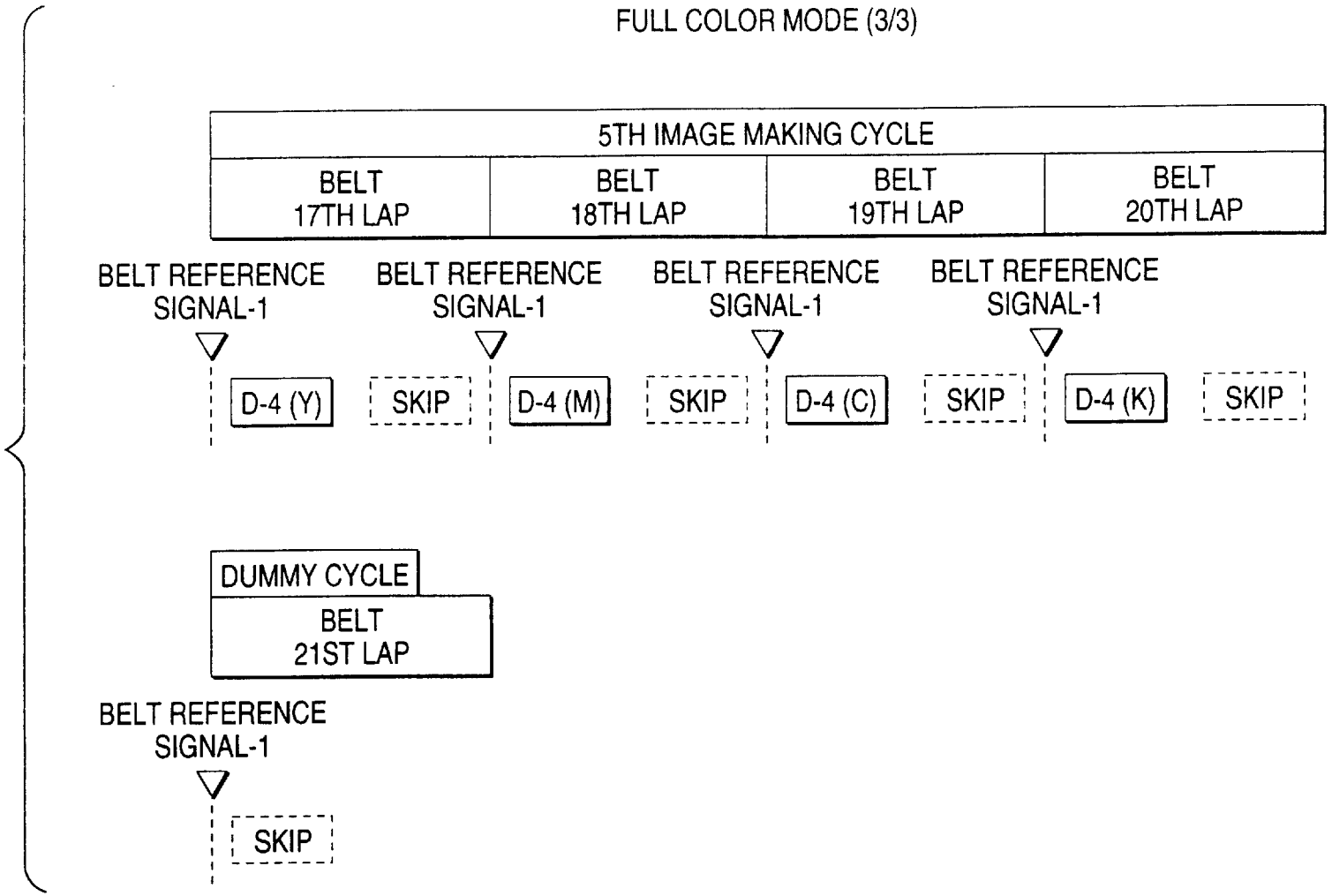
FIG. 14 is an explanatory diagram showing a third ⅓ of a process of a full color mode used in the job 1 of FIG. 11.

The job 1 and job 2 shown in FIG. 11 are to make four duplex prints each. The detail of the job 1 of FIG. 11 is shown in FIGS. 12 to 14. As to the job 1, it is assumed that a belt reference signal-1 has been selected. FIGS. 12 to 14 show only the images to be formed in each rotation of the intermediate transfer belt 20 in each image making cycle and omit those images already formed in the image making cycles.

Suppose a job command for the job 1 is entered into the image making controller 100. In the first making cycle (first lap to fourth lap of the intermediate transfer belt), at each rotation of the intermediate transfer belt 20 the image making controller 100 skips the first image carrying region G1 on the front part of the intermediate transfer belt 20 according to the belt reference signal-1 and then transfers a first-side image S-1 for the first sheet (more specifically, component color images of yellow, magenta, cyan and black S-1(Y), S-1(M), S-1(C), S-1(K) onto the second image carrying region G2 according to the timing signal based on the belt reference signal-1.

When the intermediate transfer belt 20 has rotated four times, the second image carrying region G2 on the intermediate transfer belt 20 carries the first-side image S-1 for the first sheet (a multiple transfer image consisting of component color images) and then transfers the image onto the first side (front side) of the first sheet, thus completing the first image making cycle.

Then, after this sheet with the image transferred thereon undergoes the fixing process in the fixing device 42, it is transported to the secondary transfer position through the paper return mechanism 60.

Next, in the second image making cycle (fifth lap to eighth lap of the intermediate transfer belt), at each rotation of the intermediate transfer belt 20 the image making controller 100 transfers a second-side image D-1 for the first sheet (more specifically, component color images of yellow, magenta, cyan and black D-1(Y), D-1(M), D-1(C), D-1(K)) onto the first image carrying region G1 on the front part of the intermediate transfer belt 20 according to the belt reference signal-1 and then transfers a first-side image S-2 for the second sheet (more specifically, component color images of yellow, magenta, cyan and black S-2(Y), S-2(M), S-2(C), S-2(K)) onto the subsequent second image carrying region G2 according to a timing signal based on the belt reference signal-1.

When the intermediate transfer belt 20 has rotated four times, the first image carrying region G1 on the intermediate transfer belt 20 carries the second-side image D-1 for the first sheet (a multiple transfer image consisting of component color images) and the second image carrying region G2 carries the first-side image S-2 for the second sheet (a multiple transfer image consisting of component color images). At the secondary transfer position, the two images on the intermediate transfer belt 20 are transferred onto the second side (back side) of the first sheet and the first side (front side) of the second sheet, respectively, thus completing the second image making cycle.

Then, the two sheets with their images successively transferred thereon undergo the fixing process in the fixing device 42. The sheets with their images fixed on both sides are discharged through the paper discharge path 61 onto a discharge tray not shown. The sheets with their images fixed only on one side are transported through the paper return mechanism 60 to the secondary transfer position again.

Next, in the third image making cycle (ninth lap to twelfth lap of the intermediate transfer belt), at each rotation of the intermediate transfer belt 20 the image making controller 100 transfers a second-side image D-2 for the second sheet (more specifically, component color images of yellow, magenta, cyan and black D-2(Y), D-2(M), D-2(C), D-2(K)) onto the first image carrying region G1 on the front part of the intermediate transfer belt 20 according to the belt reference signal-1 and then transfers a first-side image S-3 for the third sheet (more specifically, component color images of yellow, magenta, cyan and black S-3(Y), S-3(M), S-3(C), S-3(K)) onto the subsequent second image carrying region G2 according to a timing signal based on the belt reference signal-1. After the intermediate transfer belt 20 has made a fourth round, the image making controller 100 transfers the images D-2, S-3 formed on the intermediate transfer belt 20 onto the corresponding sides of the respective sheets, and then performs the fixing process and the paper feeding process in the same way as in the second image making cycle.

Further, in the fourth image making cycle (13th lap to 16th lap of the intermediate transfer belt), at each rotation of the intermediate transfer belt 20 the image making controller 100 transfers a second-side image D-3 for the third sheet (more specifically, component color images of yellow, magenta, cyan and black D-3(Y), D-3(M), D-3(C), D-3(K)) onto the first image carrying region G1 on the front part of the intermediate transfer belt 20 according to the belt reference signal-1 and then transfers a first-side image S-4 for the fourth sheet (more specifically, component color images of yellow, magenta, cyan and black S-4(Y), S-4(M), S-4(C), S-4(K)) onto the subsequent second image carrying region G2 according to a timing signal based on the belt reference signal-1. After the intermediate transfer belt 20 has made a fourth round, the image making controller 100 transfers the images D-3, S-4 formed on the intermediate transfer belt 20 onto the corresponding sides of the respective sheets, and then performs the fixing process and the paper feeding process in the same way as in the second image making cycle.

Then, in the final image making cycle, at each rotation of the intermediate transfer belt 20, the image making controller 100 transfers a second-side image D-4 for the fourth sheet (more specifically, component color images of yellow, magenta, cyan and black D-4(Y), D-4(M), D-4(C), D-4(K)) onto the first image carrying region G1 on the front part of the intermediate transfer belt 20 according to the belt reference signal-1 and skips the subsequent second image carrying region G2.

After the intermediate transfer belt 20 has made a fourth round, the image making controller 100 transfers the image D-4 formed on the intermediate transfer belt 20 onto the corresponding side of the final sheet, and then performs the fixing process by the fixing device before discharging the printed sheet onto a discharge tray not shown.

Now, a series of processing according to the full color mode (automatic duplex mode) are finished, producing four sheet with color images printed on both sides.

In this stage, the image making cycle on the job 1 is completed and, before proceeding to the job 2, the image making controller 100 performs a reference signal change processing shown in FIG. 6.

In this embodiment, by the time a series of image making cycles are completed, the intermediate transfer belt 20 has made 20 rounds, so the count C at this point in time is even-numbered. Hence, the image making controller 100, as shown FIGS. 11 and 14, performs a dummy cycle (a first half of the 21th lap of the intermediate transfer belt) in which the intermediate transfer belt 20 is rotated through a half turn to skip the first image carrying region G1 and thereby count up the detection signal from the mark sensor 92 by one. In this condition, the controller stops the belt motor (not shown).

In this state, the belt reference signal is switched from the belt reference signal-1 to a belt reference signal-2 (a reference signal based on a detection signal from the mark sensor 92 associated with the second reference mark 912).

After this, the image making controller 100 executes a job command associated with the job 2 as shown in FIG. 11 to perform the first to fifth image making cycles. Then the controller 100 performs the reference signal change processing before stopping the apparatus.

In plural jobs in the full color simplex mode (FIGS. 7 to 10) or in plural jobs in the full color duplex mode (FIGS. 11 to 14), because the reference signal change processing is performed for each job, the frequency of use of the first image carrying region G1 and the second image carrying region G2 on the intermediate transfer belt 20 becomes uniform, thus effectively preventing the local resistance degradation of the intermediate transfer belt 20 and the local adhesion of toner release agent onto the intermediate transfer belt 20.

Figure 15:
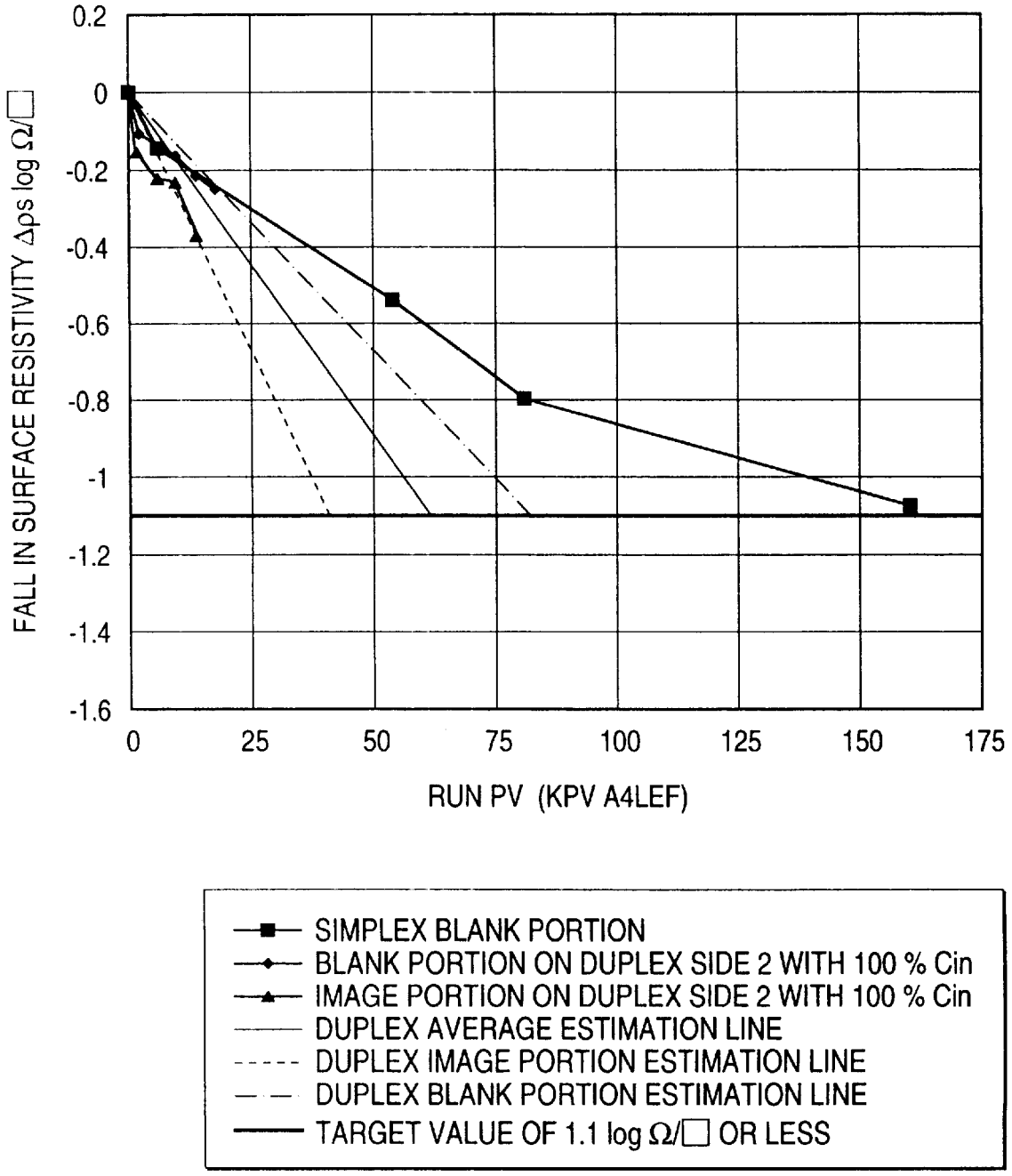
FIG. 15 is a graph showing resistance changes of the second side (side 2) in the duplex mode.

An experiment conducted by the inventors of the present invention has found that, as shown in FIG. 15, in the full color duplex mode the reduction in the surface resistivity of the intermediate transfer belt 20 which is passed by the second-side image portion (corresponding to the image portion on duplex side 2 with 100% Cin [image coverage]) is relatively larger than those of the second-side blank portion (corresponding to the black portion on duplex side 2 with 100% Cin), which is a second-side non-image portion, and of the first-side blank portion (corresponding to the simplex blank portion. In this experiment the number of prints of A4 size set in lateral arrangement (A4 LEF) and the reduction in the surface resistivity were measured or predicted for the second-side image portion, and a target value for the reduction in surface resistivity was set at 1.1 logΩ/ or less.

Figure 16:
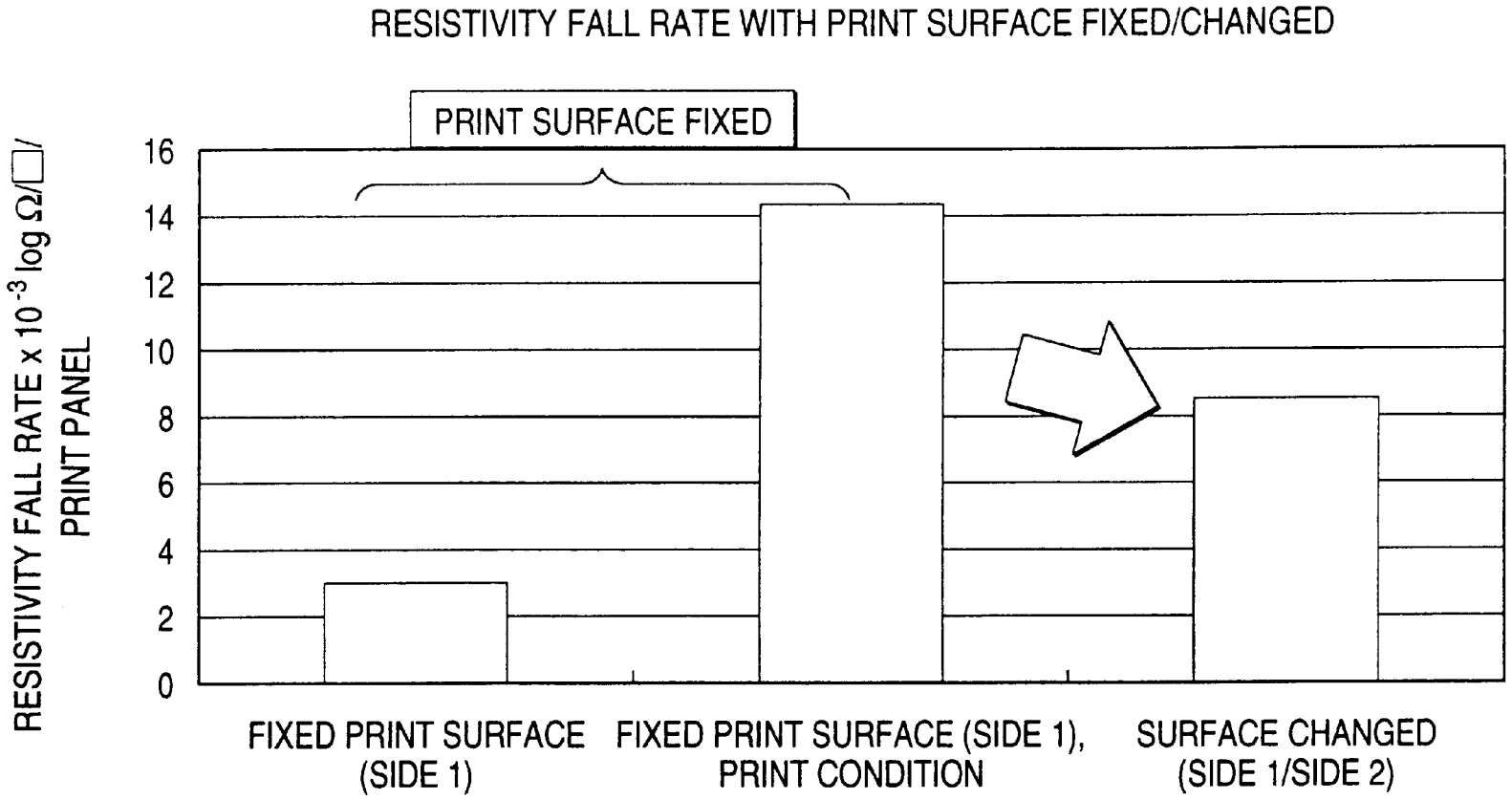
FIG. 16 is an explanatory diagram showing a performance evaluation of this embodiment and an embodiment for comparison.

The rate of reduction of resistivity on each print surface was investigated for an example case where the first side (duplex side 1) and the second side (duplex side 2) in the full color duplex mode are fixed to either of the image carrying regions G1, G2 of the intermediate transfer belt 20 (case for comparison: print surface fixed). FIG. 16 is the result of measurement, which shows that the rate of reduction of resistivity on the second side (duplex side 2) is very large (in this example, $14.2\times10^{-3}$ logΩ/ ).

In this embodiment, on the other hand, which alternately switches the print surface between the first and the second side in the full color duplex mode, the rate of reduction of resistivity of the intermediate transfer belt 20 is lowered to around $8.53\times10^{-3}$logΩ/ . It is therefore understood that the local degradation of the intermediate transfer belt 20 can be reduced to that extent.

Further, in this embodiment, because the image carrying regions G1, G2 on the intermediate transfer belt 20 for carrying the second-side image is switched and selected, the release agent is transferred onto the intermediate transfer belt 20 during the transfer of the second-side image. At this time, the release agent does not locally or unevenly adhere to only one of the image carrying regions G1, G2 of the intermediate transfer belt 20. Hence, image defects will not occur easily due to the release agent adhering to only one of the image carrying regions G1, G2.

In the full color duplex mode of this embodiment, in particular, to prevent fusing variations and oil ghost, an adjustment should be made so that the amount of oil that adheres to the back of the sheet during the fixing of a first-side image will not become excessive.

The experiments conducted by the inventors of this invention show that because in the second and subsequent image making cycles a process is performed to form a second-side image on the first image carrying region G1 (or G2) on the front part of the intermediate transfer belt 20, the oil supply rate of the oil supply device 81 on the pressurizing fixing roll 72 side during the second image fixing needs to be set at 3.0 μl/A4 or less, preferably at 0.7 μl/A4 to 1.5 μl/A4.

At this time, because the fixing device 42 needs to fix images on two sheets continuously, the amount of oil supply from the oil supply device 81 must be set by considering the amount of oil absorbed by the leading sheet and the above-described oil amount.

Actually, this embodiment exhibited no fusing variations and oil ghost in the full color mode (automatic duplex mode).

Figure 17:
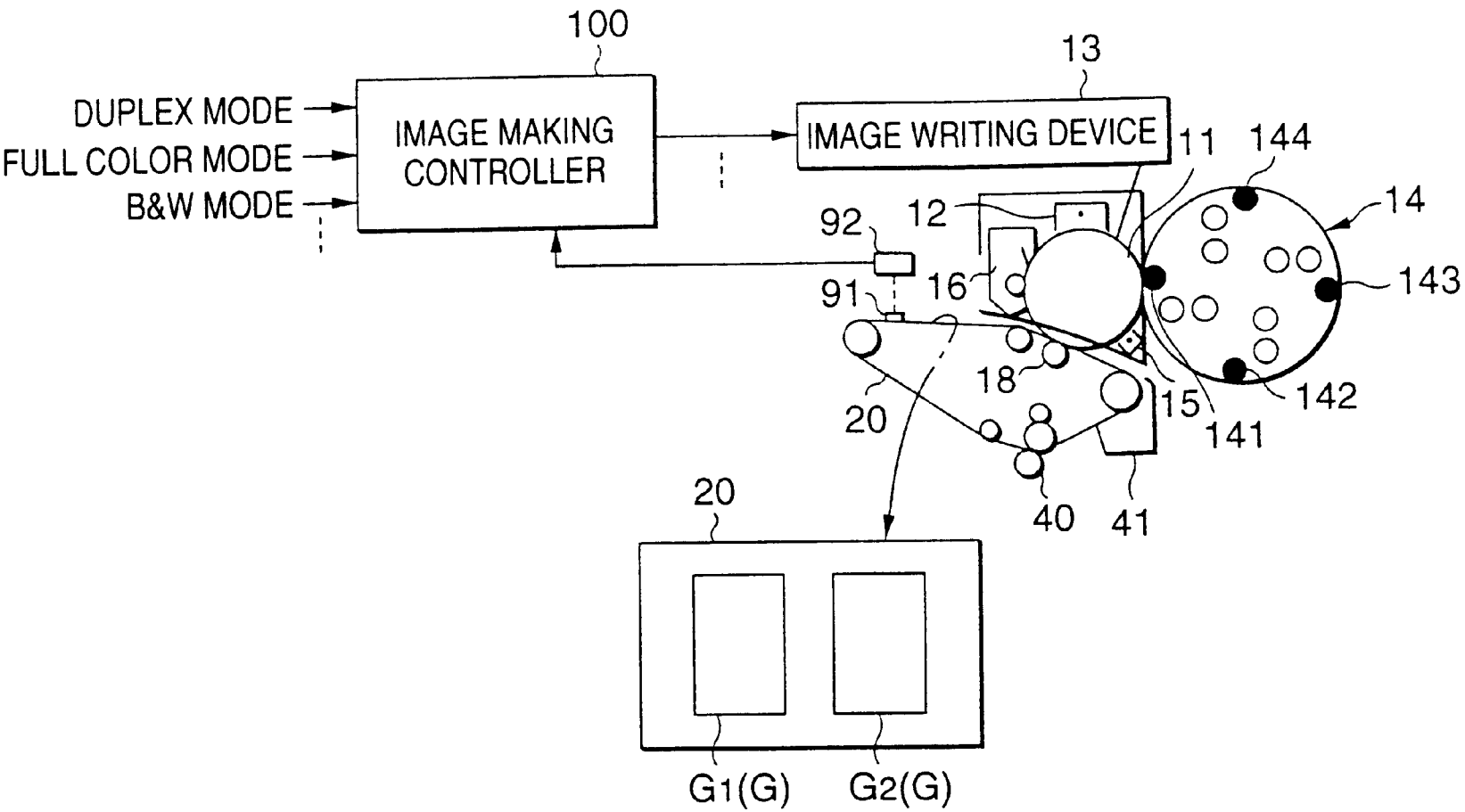
FIG. 17 is a block diagram showing a variation of the image making control system used in the embodiment 1.
Figure 18:
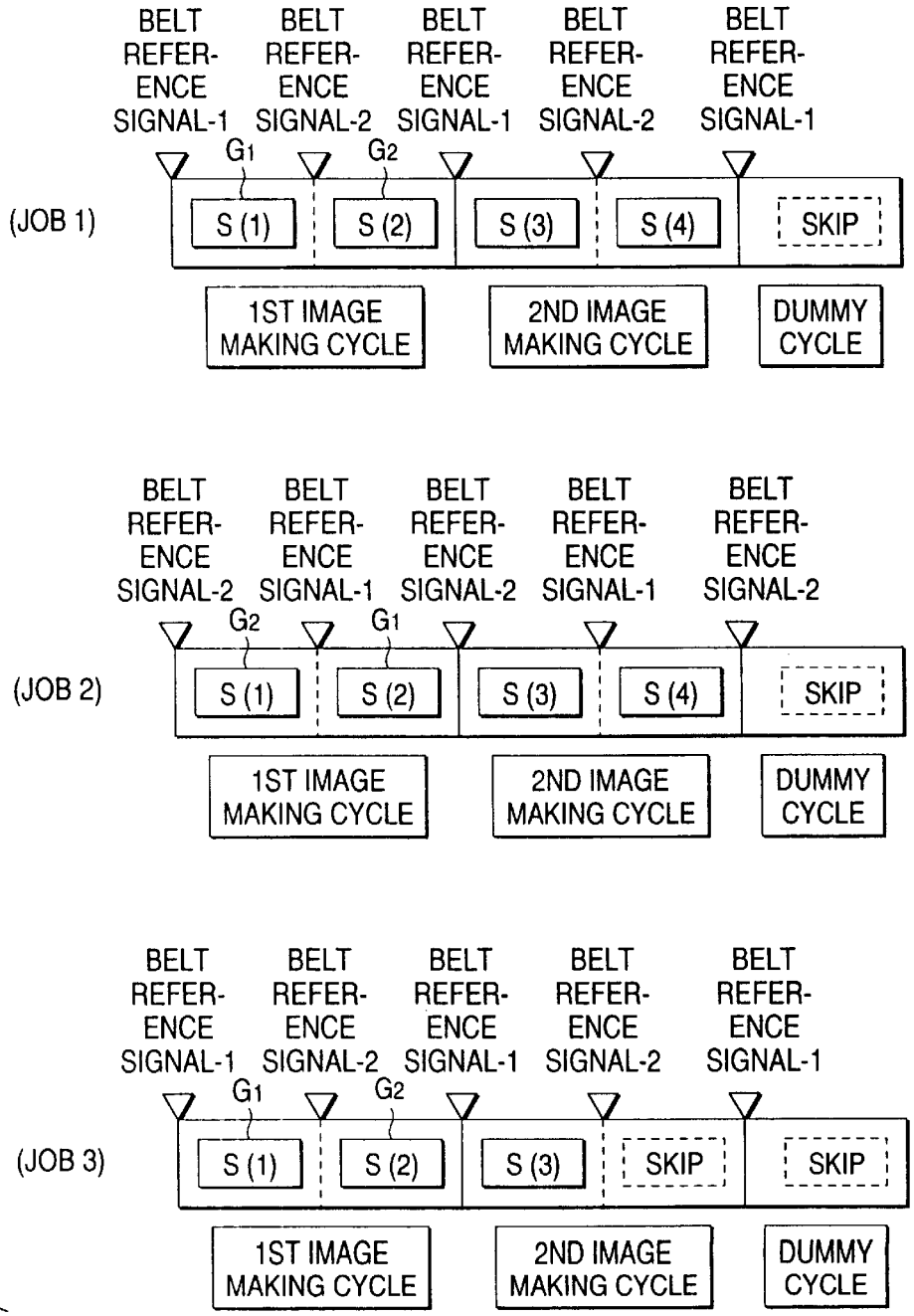
FIG. 18 is a schematic diagram showing a process covering plural jobs (simplex mode) according to an embodiment 2 of the image forming apparatus.

In this embodiment, two reference marks 911, 912 are provided on the intermediate transfer belt 20, as shown in FIG. 5, and are detected by the mark sensor 92 to generate two belt reference signals-1, 2. Other arrangements may be employed. For example, as shown in FIG. 17, a reference mark 91 may be provided on the intermediate transfer belt 20 and detected by the mark sensor 92 to directly produce one belt reference signal-1 and a timing signal generated by a timer based on the detection signal from the mark sensor 92 may be used as a belt reference signal-2.

When this arrangement is adopted, however, it is necessary to provide a means (such as a job counter) to identify what the belt reference signal used by the present job is.

EMBODIMENT 2

The basic configuration of the image forming apparatus according to this embodiment is almost similar to that of the embodiment 1. Unlike the embodiment 1, the embodiment 2 uses the belt reference signal-2 (or belt reference signal-1) corresponding to the subsequent second image carrying region G2 (G1), as is, as the reference signal to write an image onto the subsequent second image carrying region G2 (G1).

The operation of the image forming apparatus according to this embodiment will be described.

Full Color Simples Mode

Figure 19:
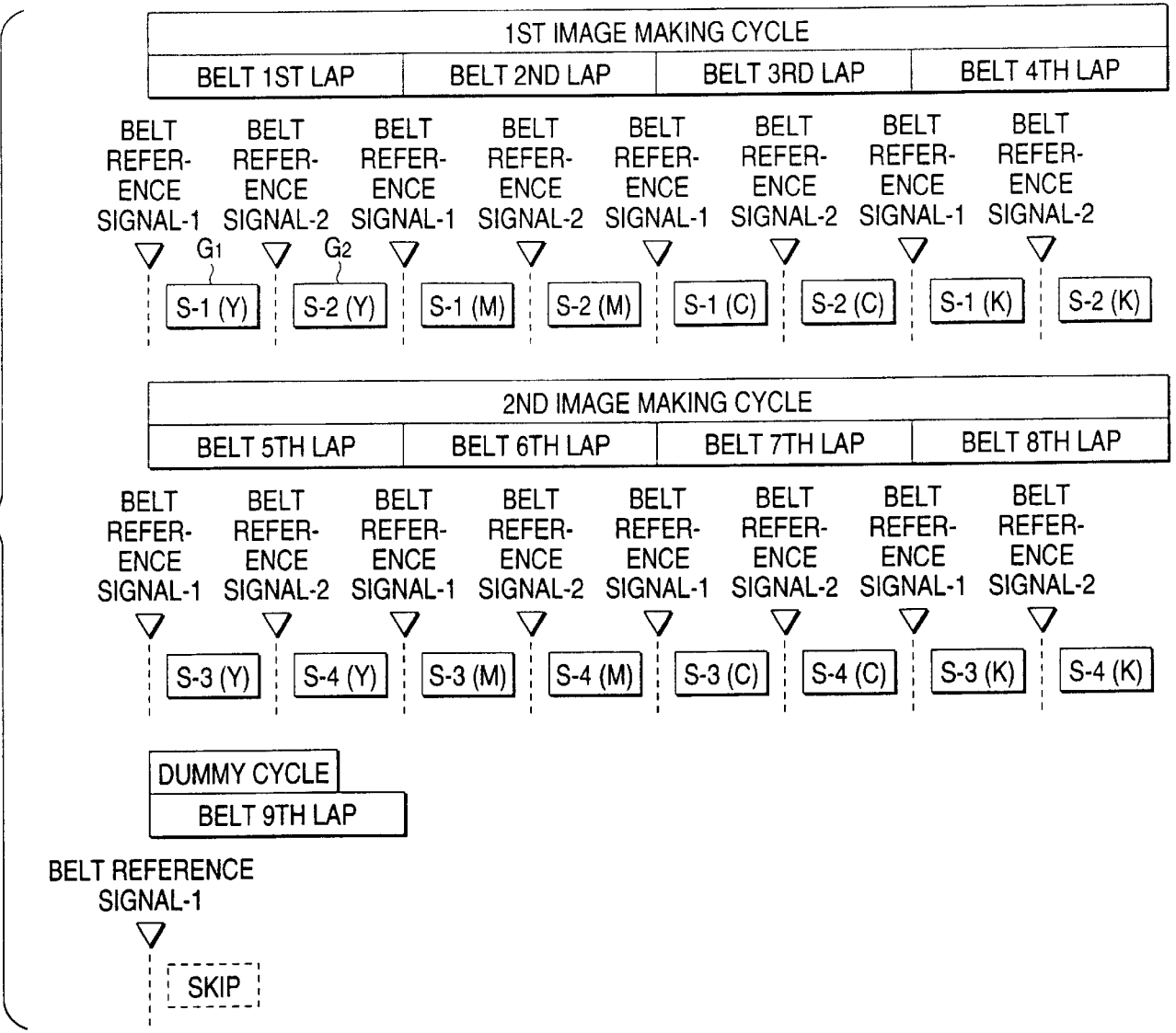
FIG. 19 is a schematic diagram showing the detail of a process of the job 1 of FIG. 18.

First, an example case in which three job commands (job 1, job 2, job 3) of full color simplex mode are issued will be explained below. The detail of the job 1 is shown in FIG. 19.

Now, suppose a job command for the job 1 is entered into the image making controller 100. In the first image making cycle (first lap to fourth lap of the intermediate transfer belt), at each rotation of the intermediate transfer belt 20 the image making controller 100 transfers an image S-1 for the first sheet (more specifically, component color images of yellow, magenta, cyan and black S-1(Y), S-1(M), S-1(C), S-1(K)) onto the first image carrying region G1 on a front part of the intermediate transfer belt 20 according to the belt reference signal-1 and also transfers an image S-2 for the second sheet (more specifically, component color images of yellow, magenta, cyan and black S-2(Y), S-2(M), S-2(C), S-2(K)) onto the subsequent second image carrying region G2 according to the belt reference signal-2.

When the intermediate transfer belt 20 has rotated four times, the first and second image carrying regions G1, G2 on the intermediate transfer belt 20 carry the images S1, S-2 for the first and second sheets (multiple transfer image each consisting of component color images) and then transfer there images onto one side (first side) of the first and second sheets, respectively, thus completing the first image making cycle.

Then, after the sheets with their images transferred thereon undergo the fixing process in the fixing device 42, they are discharged through the paper discharge path 61 onto a discharge tray not shown.

Next, in the second image making cycle (fifth lap to eighth lap of the intermediate transfer belt), at each rotation of the intermediate transfer belt 20 the image making controller 100 transfers an image S-3 for the third sheet (more specifically, component color images of yellow, magenta, cyan and black S-3(Y), S-3(M), S-3(C), S-3(K)) onto the first image carrying region G1 on the front part of the intermediate transfer belt 20 according to the belt reference signal-1 and then transfers an image S-4 for the fourth sheet (more specifically, component color images of yellow, magenta, cyan and black S-4(Y), S-4(M), S-4(C), S-4(K)) onto the subsequent second image carrying region G2 according to the belt reference signal-2.

When the intermediate transfer belt 20 has rotated four times, the first image carrying region G1 on the intermediate transfer belt 20 carries the image S-3 for the third sheet (a multiple transfer image consisting of component color images) and the second image carrying region G2 carries the image S-4 for the fourth sheet (a multiple transfer image consisting of component color images). At the secondary transfer position, the two images on the intermediate transfer belt 20 are transferred onto one side (first side) of the third and fourth sheets, respectively, thus completing the second image making cycle.

Then, after the two sheets with their images successively transferred thereon undergo the fixing process in the fixing device 42, they are discharged though the paper discharge path 61 onto a discharge tray not shown.

In this stage, the image making cycle on the job 1 is completed and the image making controller 100 performs the reference signal change processing shown in FIG. 6 to switch to a desired belt reference signal, before proceeding to the job 2.

After this, the image making controller 100 executes a job command for the job 2 as shown in FIG. 19.

In the first image making cycle (first lap to fourth lap of the intermediate transfer belt), at each rotation of the intermediate transfer belt 20 the image making controller 100 transfers an image S-1 for the first sheet (more specifically, component color images of yellow, magenta, cyan and black S-1(Y), S-1(M), S-1(C), S-1(K)) onto the second image carrying region G2 on a front part of the intermediate transfer belt 20 according to the belt reference signal-2 and also transfers an image S-2 for the second sheet (more specifically, component color images of yellow, magenta, cyan and black S-2(Y), S-2(M), S-2(C), S-2(K)) onto the subsequent first image carrying region G1 according to the belt reference signal-1.

When the intermediate transfer belt 20 has rotated four times, the second and first image carrying regions G2, G1 on the intermediate transfer belt 20 carry the images S-1, S-2 for the first and second sheet (multiple transfer images each consisting of component color images) and then transfer theses images onto one side (first side) of the first and second sheets, respectively, thus completing the first image making cycle.

Then, after the sheets with their images transferred thereon undergo the fixing process in the fixing device 42, they are discharged through the paper discharge path 61 onto a discharge tray not shown.

Next, in the second image making cycle (fifth lap to eighth lap of the intermediate transfer belt), at each rotation of the intermediate transfer belt 20 the image making controller 100 transfers an image S-3 for the third sheet (more specifically, component color images of yellow, magenta, cyan and black S-3(Y), S-3(M), S-3(C), S-3(K)) onto the second image carrying region G2 on the front part of the intermediate transfer belt 20 according to the belt reference signal-2 and then transfers an image S-4 for the fourth sheet (more specifically, component color images of yellow, magenta, cyan and black S-4(Y), S-4(M), S-4(C), S-4(K)) onto the subsequent first image carrying region G1 according to the belt reference signal-1.

When the intermediate transfer belt 20 has rotated four times, the second image carrying region G2 on the intermediate transfer belt 20 carries the image S-2 for the third sheet (a multiple transfer image consisting of component color images) and the first image carrying region G1 carries the image S-4 for the fourth sheet (a multiple transfer image consisting of component color images). At the secondary transfer position, the two images on the intermediate transfer belt 20 are transferred onto one side (first side) of the third and fourth sheets, respectively, thus completing the second image making cycle.

Then, after the two sheets with their images successively transferred thereon undergo the fixing process in the fixing device 42, they are discharged through the paper discharge path 61 onto a discharge tray not shown.

In this stage, the image making cycle on the job 2 is completed and the image making controller 100 performs the reference signal change processing shown in FIG. 6 to switch to a desired belt reference signal, before executing a job command for the job 3.

After the image making cycles on the job 3 are finished, the image making controller 100 performs the reference signal change processing and stops the apparatus.

EMBODIMENT 3

The basic configuration of the image forming apparatus according to this embodiment is almost similar to that of the embodiment 1. Unlike the embodiment 1, the embodiment 3 performs the reference signal change processing after the start of the apparatus before executing the image making cycles on a job.

Figure 20:
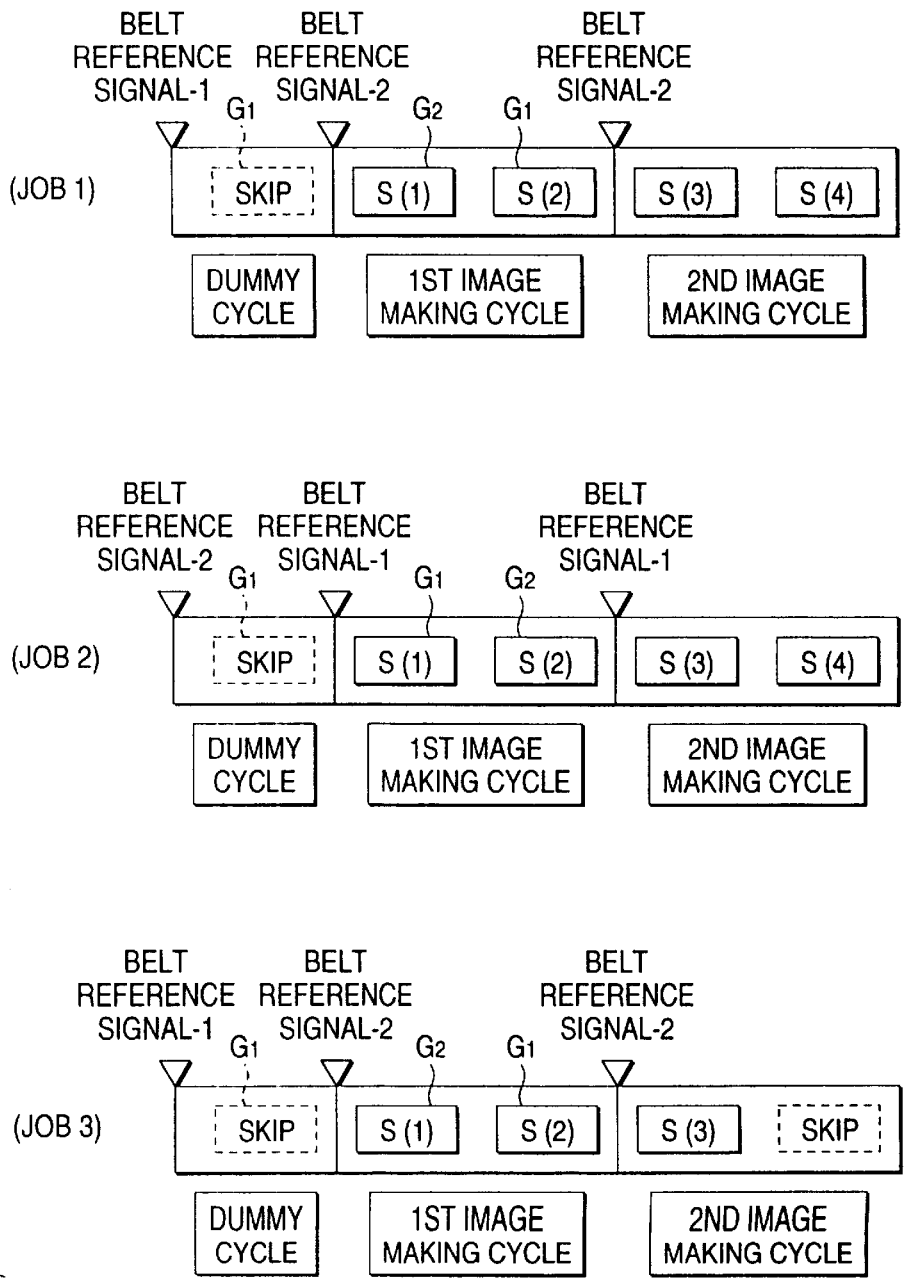
FIG. 20 is a schematic diagram showing a process covering plural jobs (simplex mode) according to an embodiment 3 of the image forming apparatus.

When we consider an example case in which three job commands (job 1, job 2, job 3) are received as shown in FIG. 20, the image making controller 100 performs the reference signal change processing before executing the image making cycles on the job 1. The detail of the job 1 is shown in FIG. 21.

Figure 21:
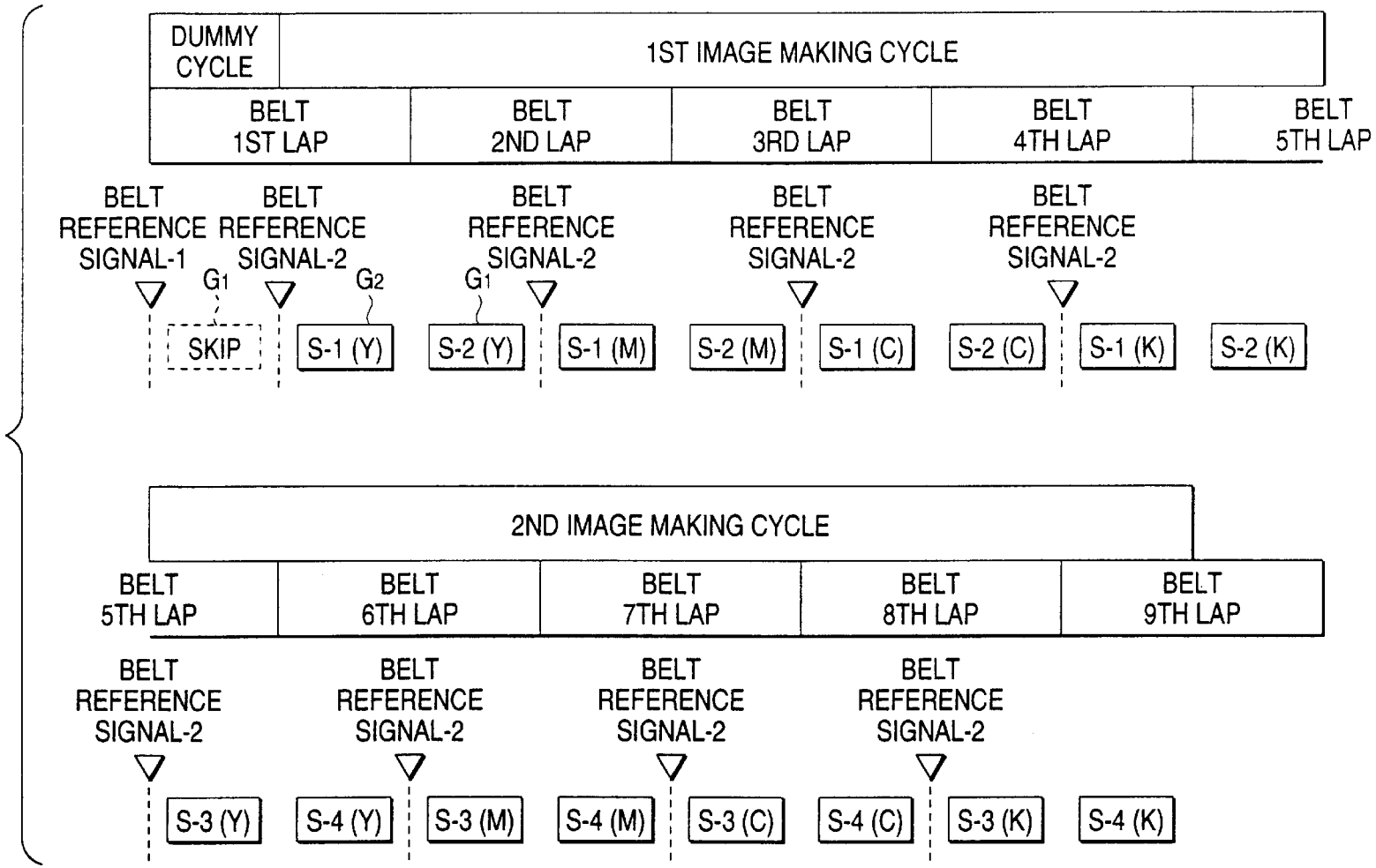
FIG. 21 is a schematic diagram showing the detail of a process of the job 2 of FIG. 20.

The reference signal change processing according to this embodiment, as shown in FIG. 21, performs a dummy cycle (a first half of the first lap of the intermediate transfer belt) in which the intermediate transfer belt 20 is rotated through a half turn to skip the leading image carrying region (in this example, the first image carrying region G1).

After this, the image making controller 100 performs the image making cycles on the job 1 (first and second image making cycles) according to the belt reference signal-1 and the timing signal based on the belt reference signal-2 and then executes the reference signal change processing (by skipping the second image carrying region G2). The image making controller 100 then performs the image making cycles on the job 2 according to the belt reference signal-1 and the timing signal based on the belt reference signal-1, and then performs the reference signal change processing (by skipping the first image carrying region G1). After this, the image making controller 100 executes the image making cycles on the job 3 according to the belt reference signal-2 and the timing signal based on the belt reference signal-2.

EMBODIMENT 4

The image forming apparatus according to this embodiment is almost similar in basic configuration to the embodiment 3 and performs the reference signal change processing after the start of the apparatus before executing the image making cycles on a job. Unlike the embodiment 3, the embodiment 4 makes images on the leading image carrying region G1 (G2) and the subsequent image carrying region G2 (G1) according to the corresponding belt reference signal-1, -2.

Figure 22:
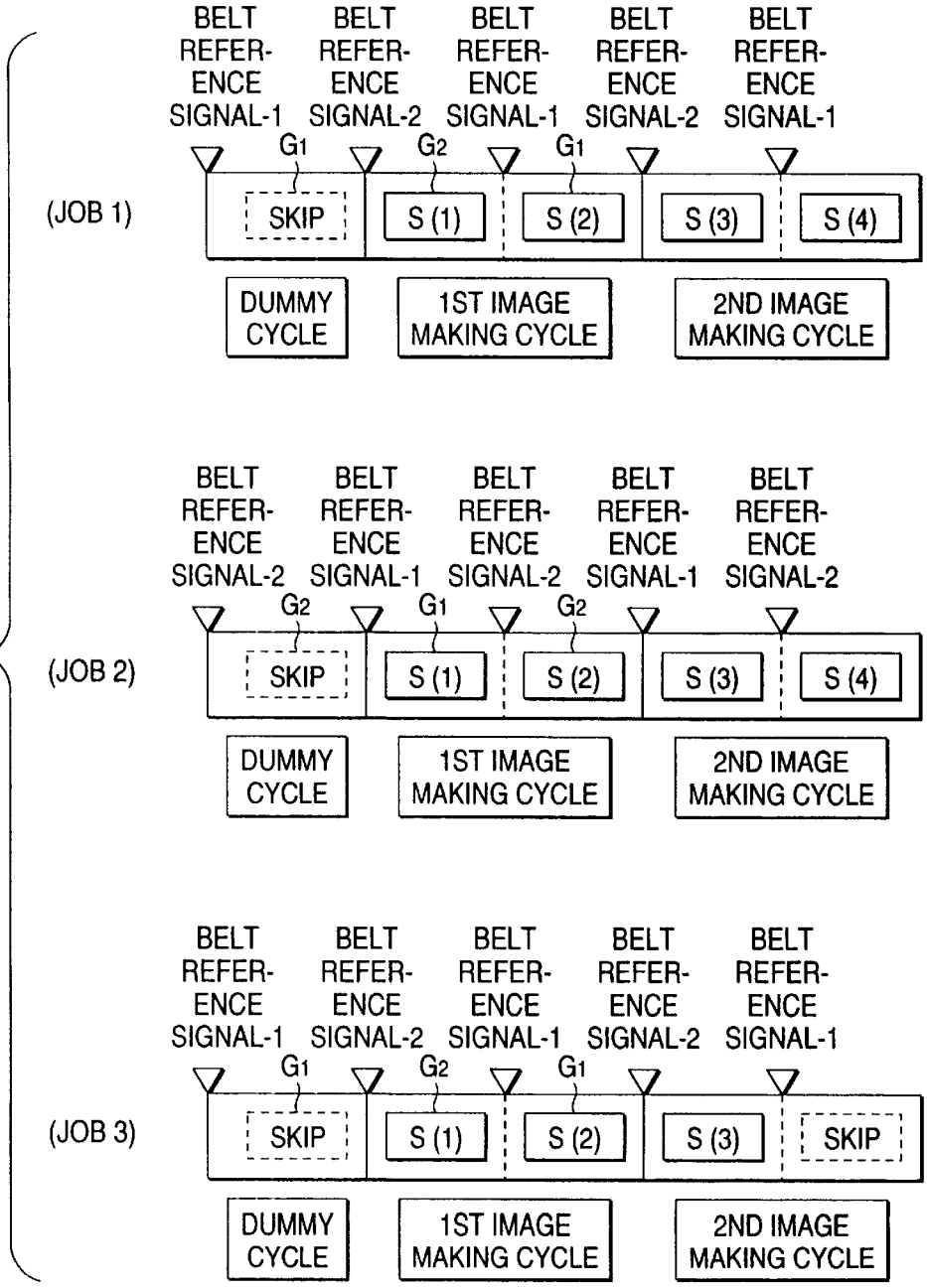
FIG. 22 is a schematic diagram showing a process covering plural jobs (simplex mode) according to an embodiment 4 of the image forming apparatus.
Figure 23:
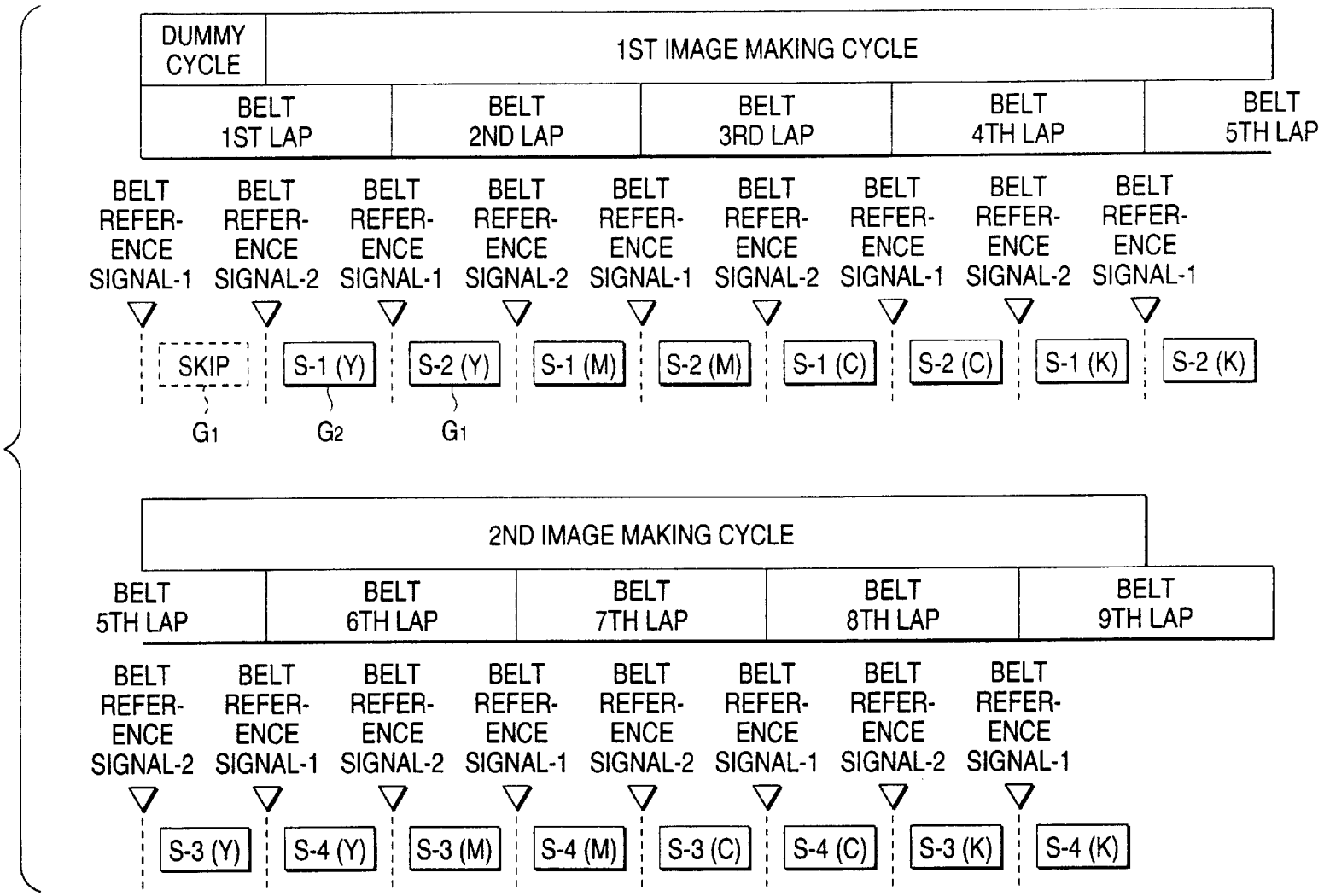
FIG. 23 is a schematic diagram showing the detail of a process of the job 1 of FIG. 22.

An example image making process performed by the image forming apparatus of this embodiment is shown in FIGS. 22 and 23.

When we consider an example case in which three job commands (job 1, job 2, job 3) are received as shown in FIG. 22, the image making controller 100 performs the reference signal change processing before executing the image making cycles on the job 1.

The reference signal change processing according to this embodiment, as shown in FIG. 23, performs a dummy cycle (a first half of the first lap of the intermediate transfer belt) in which the intermediate transfer belt 20 is rotated through a half turn to skip the leading image carrying region (in this example, the first image carrying region G1).

After this, the image making controller 10 performs the image making cycles on the job 1 (first and second image making cycles) according to the belt reference signal-2 and the belt reference signal-1 and then executes the reference signal change processing (by skipping the second image carrying region G2). The image making controller 100 then performs the image making cycles on the job 2 according to the belt reference signal-1 and the belt reference signal-2, and then performs the reference signal change processing (by skipping the first image carrying region G1). After this, the image making controller 100 executes the image making cycles on the job 3 according to the belt reference signal-2 and the belt reference signal-1.

EMBODIMENT 5

Figure 24:
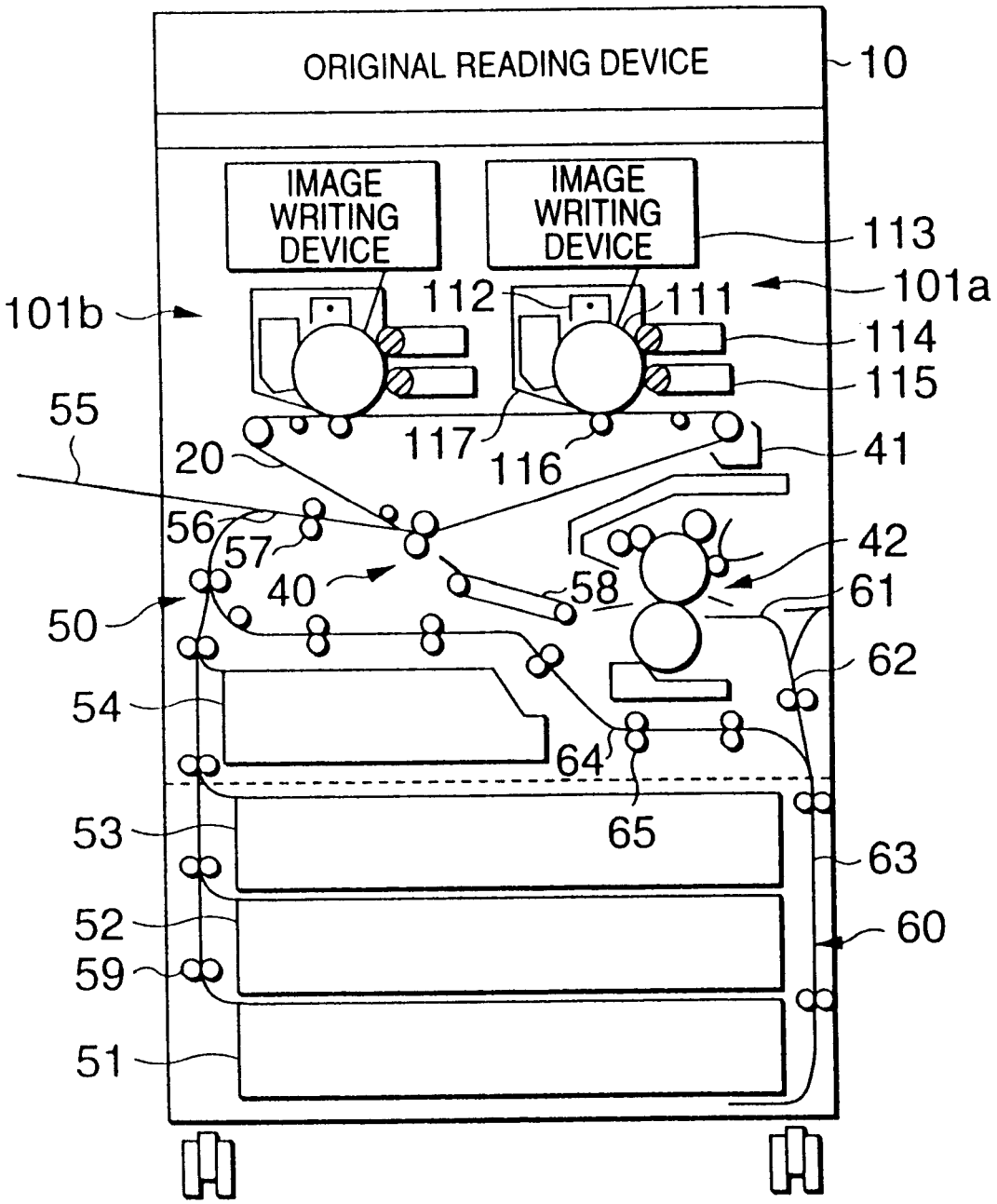
FIG. 24 is an explanatory view showing the outline of an image forming apparatus according to an embodiment 5.

FIG. 24 shows an embodiment 5 that applies the present invention to a 2-tandem type duplex image forming apparatus.

The image forming apparatus in the figure is configured almost similar to the embodiment 1 but differs from the embodiment 1 in that two image forming units 101 (101*a*, 101*b* ) of, for example, electro-photographic system each capable of forming a two-color component toner image are arranged side by side facing the intermediate transfer belt 20 whereby the intermediate transfer belt 20 is rotated through two turns to successively transfer the two-color component toner images formed on the image forming units 101 onto the intermediate transfer belt 20 at the primary transfer position and then to transfer these toner images en masse onto a sheet by the secondary transfer device 20 at the secondary transfer position.

The image forming units 101 each include a photosensitive drum 111, a charger 112, an image writing device 113, two developers 114, 115, a primary transfer device 116 and a drum cleaner 117.

As to the constitutional elements similar to those of the embodiment 1, like reference numbers are assigned and their detailed descriptions are omitted.

Figure 25:
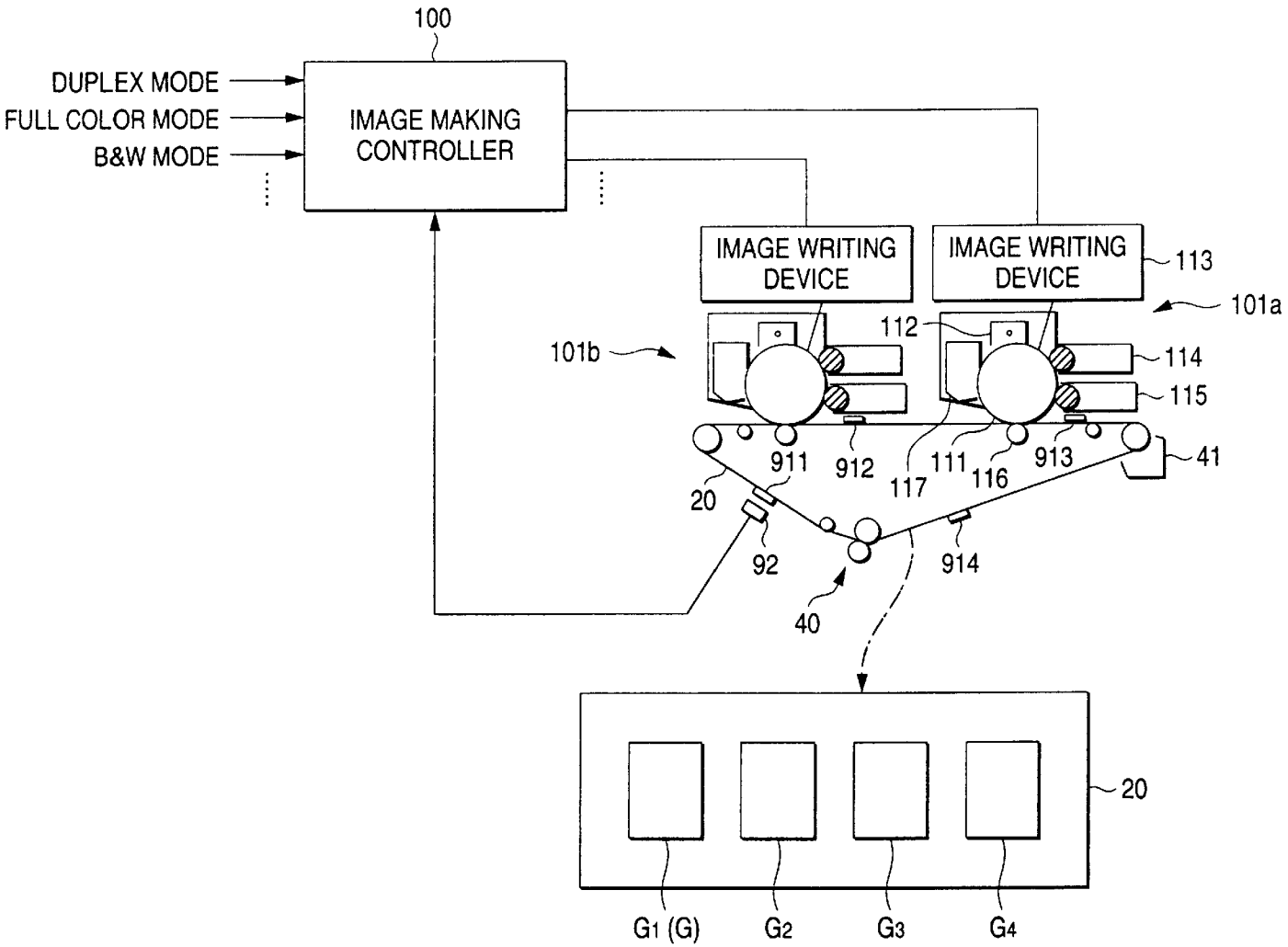
FIG. 25 is a block diagram showing an image making control system used in the embodiment 5.

As shown in FIG. 25, this embodiment differs from the embodiment 1 in that the intermediate transfer belt 20 has four image carrying regions (G1, G2, G3, G4) of the JIS A4 size. The image making controller 100 detects four reference marks 911–914 installed at predetermined intervals on the intermediate transfer belt 20 by the mark sensor 92 to control the image carrying regions G1–G4 on the intermediate transfer belt 20 and execute the image making in the full color duplex mode according to a predetermined procedure.

Next, an image making process in the full color duplex mode by the 2-tandem type image forming apparatus of this invention will be explained.

Figure 26:
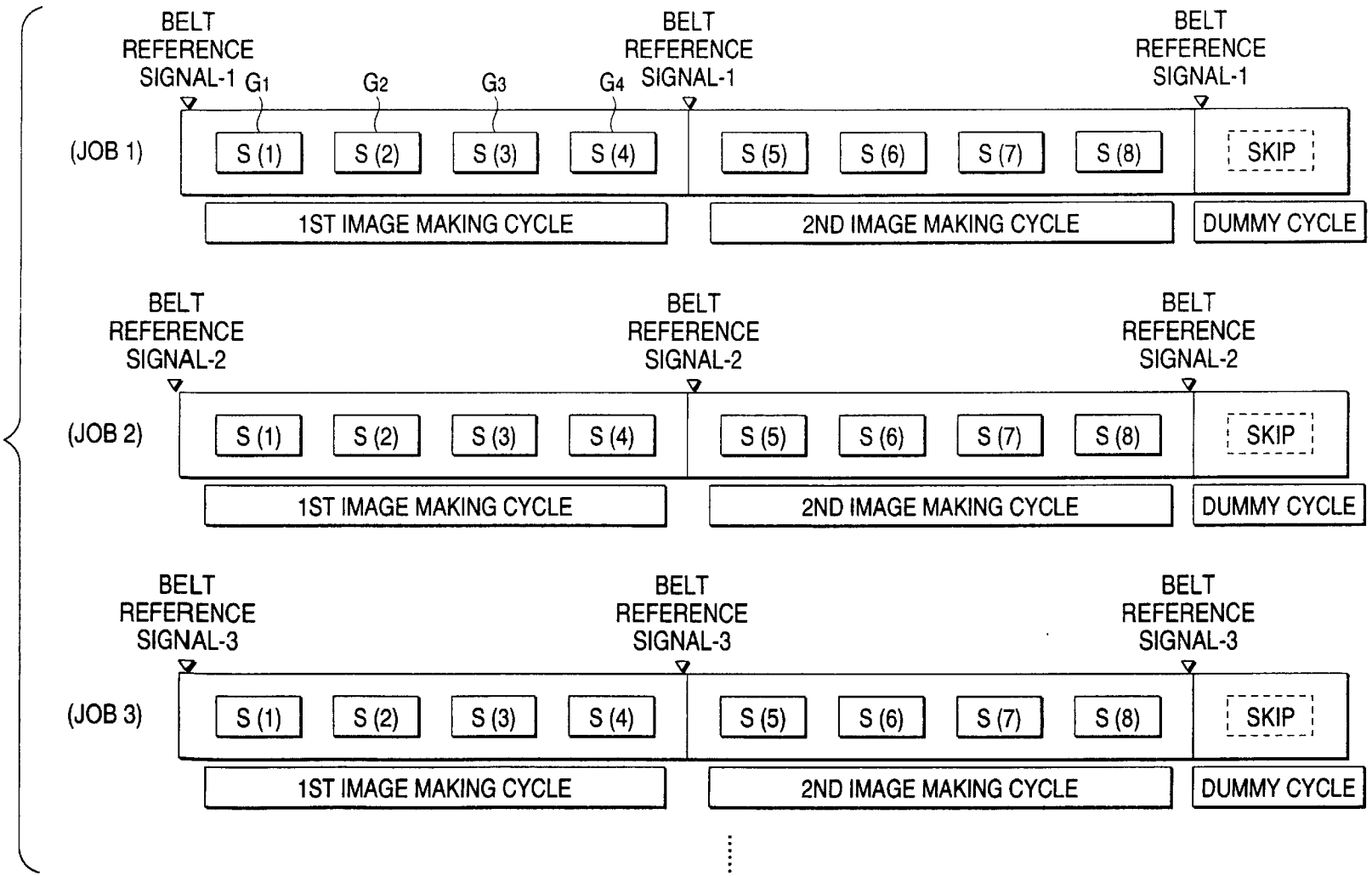
FIG. 26 is a schematic diagram showing a process covering plural jobs (simplex mode) according to the embodiment 5.

When we consider an example case in which three job commands (job 1, job 2, job 3) are received as shown in FIG. 26, the image making controller 100 performs the image making cycles on the job 1 (first and second image making cycles) according to the belt reference signal-1 and the timing signal based on the belt reference signal-1 (in this example, three timing signals are generated for the subsequent three image carrying regions) and then performs the reference signal change processing similar to the one shown in FIG. 6.

The reference signal change processing according to this embodiment, as shown in FIG. 26, performs a dummy cycle in which the intermediate transfer belt 20 is rotated through a quarter turn to skip the leading first image carrying region G1 to count up the detection signal from the mark sensor 92 by one. In this state, the belt motor (not shown) is stopped.

Next, the image making controller 100 performs the image making cycles on the job 2 (first and second image making cycles) according to the belt reference signal-2 and the timing signal based on the belt reference signal-2 (in this example, three timing signals are generated for the subsequent three image carrying regions) and then executes the reference signal change processing (by skipping the second image carrying region G2) almost similar to the one shown in FIG. 6.

The image making controller 100 then performs the image making cycles on the job 3 (first and second image making cycles) according to the belt reference signal-3 and the timing signal based on the belt reference signal-3 (in this example, three timing signals are generated for the subsequent three image carrying regions), and then performs the reference signal change processing (by skipping the third image carrying region G3) almost similar to the one shown in FIG. 6.

Further, the image making controller 100 performs the image making cycles (first and second image making cycles) on the job 4, though not shown, according to the belt reference signal-4 and the timing signal based on the belt reference signal-4 (in this example, three timing signals are generated for the subsequent three image carrying regions), and then executes the reference signal change processing (by skipping the leading fourth image carrying region G4) almost similar to the one shown in FIG. 6. After this, these processes are repeated.

While this embodiment switches among the four belt reference signals, other arrangement may be adopted. For example, one of two belt reference signals may be selected to change the image writing position for each two image carrying regions.

As to the reference signals for the subsequent image carrying regions G, the corresponding belt reference signals may be used. Alternatively, a part of the reference signals may be timing signals based on the belt reference signal corresponding to the leading image carrying region and the remaining part of the reference signals may be the corresponding belt reference signals.

Further, as in the embodiments 3 and 4, the reference signal change processing may be carried out before starting the job.

EMBODIMENT 6

Figure 27:
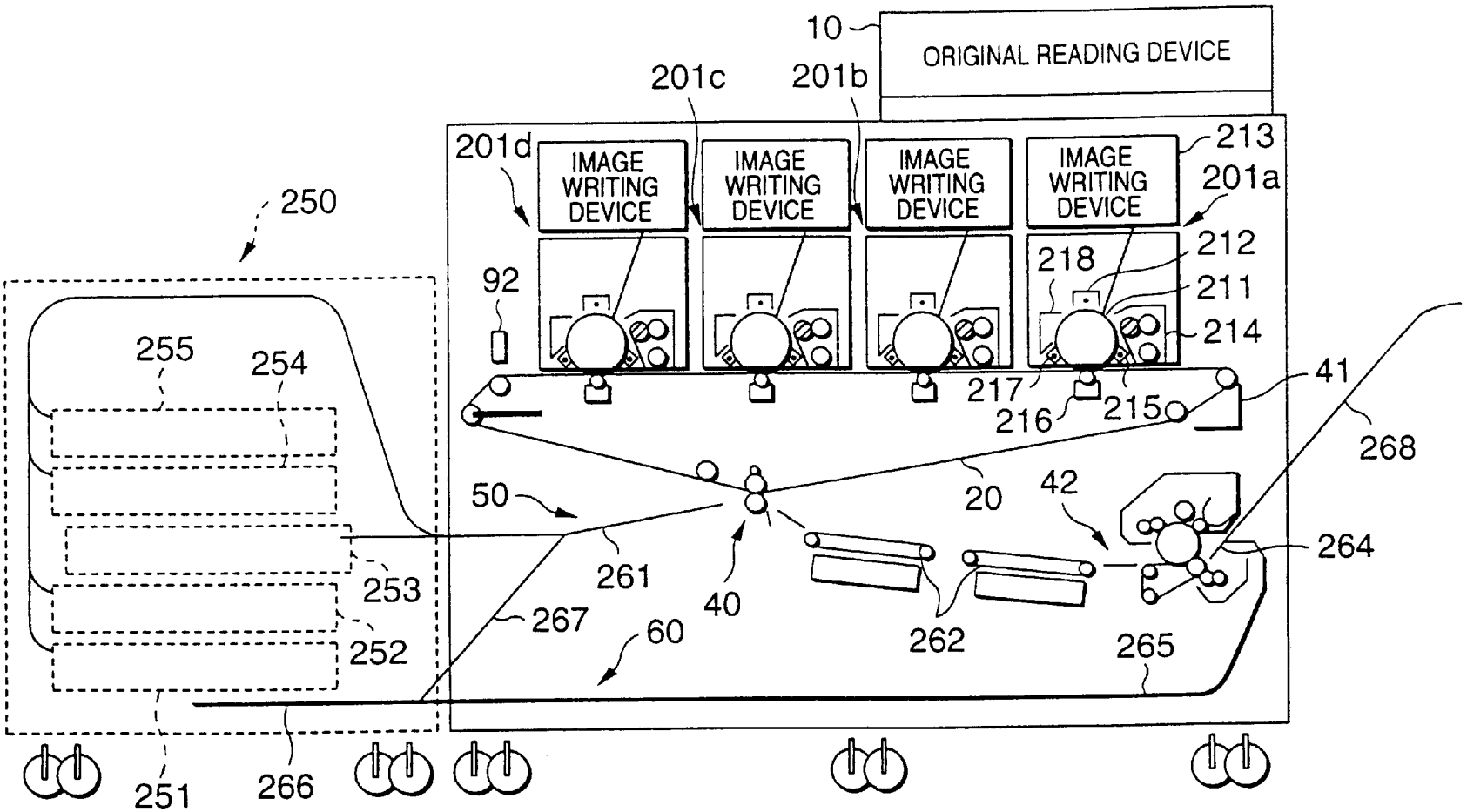
FIG. 27 is an explanatory view showing the outline of an image forming apparatus according to an embodiment 6.

FIG. 27 shows an embodiment 6 that applies the present invention to a 4-tandem type image forming apparatus.

The image forming apparatus in the figure is configured almost similar to the embodiment 1 but differs from the embodiment 1 in that four image forming units 201 (201*a*, 201*b*, 201*c*, 201*d*) of, for example, electro-photographic system each capable of forming a component color toner image are arranged side by side facing the intermediate transfer belt 20 at the primary transfer position and then these toner images on the intermediate transfer belt 20 are transferred en masse onto a sheet by the secondary transfer device 40 at the secondary transfer position.

The image forming units 201 each include a photosensitive drum 211, a charger 212, an image writing device 213, a developer 214, a pretransfer charger 215, a primary transfer device 216, a precleaner discharger 217, and a drum cleaner 218.

As to the constitutional elements similar to those of the embodiment 1, like reference numbers are assigned and their detailed descriptions are omitted.

In this embodiment, a paper supply unit 250 containing plural paper trays 251–255 is externally connected to the image forming apparatus. The paper feeding system 50 introduces a sheet from the paper supply unit 250 through a paper path 261 to the secondary transfer position. The sheet with images transferred thereon is transported through, for example, a 2-tandem transport belt 262 to the fixing device 42 (in this embodiment, a belt nip type fixing device). The sheet with images fixed on one side is turned over and returned to the secondary transfer position again through the paper return mechanism 60.

The paper return mechanism 60 has a paper branch path 265 branching downward from a paper discharge path 264 of the fixing device 42 and extending almost horizontally toward the paper supply unit 250. In the paper supply unit 250 is provided a paper reversing path 266 communicating with the paper branch path 265. The paper reversing path 266 is connected with a paper return path 267 for returning the sheet to the paper path 261 in front of the secondary transfer position.

At a predetermined position on the paper path 261 are provided registration rolls not shown. In each of these paths transport rolls not shown are installed. The transport rolls provided on the paper reversing path 266, in particular, can be rotated forwardly or backwardly at an appropriate timing. Connecting points between the paths are provided with switching gates (not shown) as required.

Figure 28:
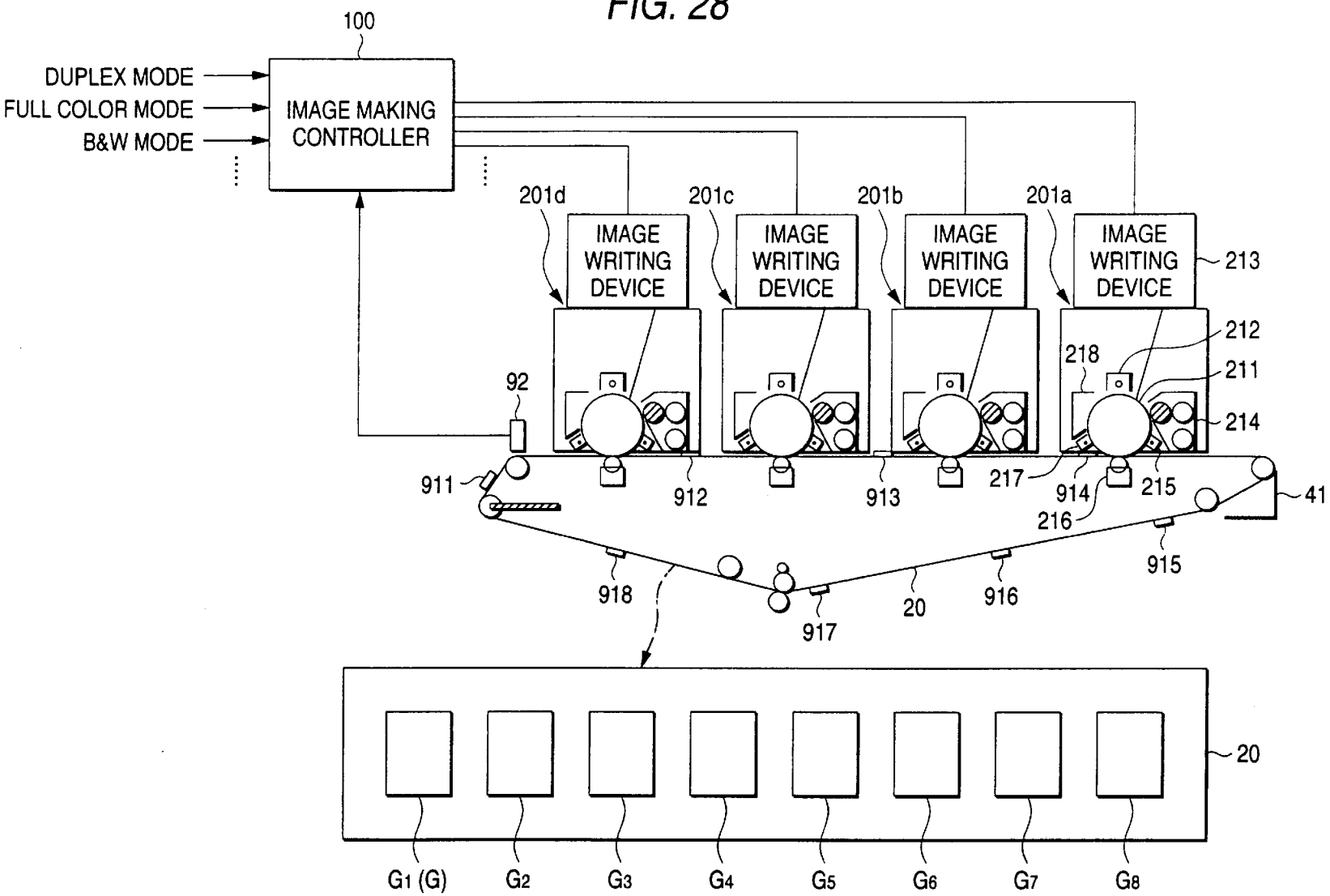
FIG. 28 is a block diagram showing an image making control system used in the embodiment 6.

In this embodiment, as shown in FIG. 28, the intermediate transfer belt 20, unlike the embodiment 1, has eight image carrying regions G (G1, G2, G3, G4, G5, G6, G7, G8) of JIS A4 size. The image making controller 100 detects eight reference marks 911–918 installed at predetermined intervals on the intermediate transfer belt 20 by the mark sensor 92 to control the image writing on the image carrying regions G1–G8 on the intermediate transfer belt 20, thereby making images in the full color duplex mode according to a predetermined procedure.

Figure 29:
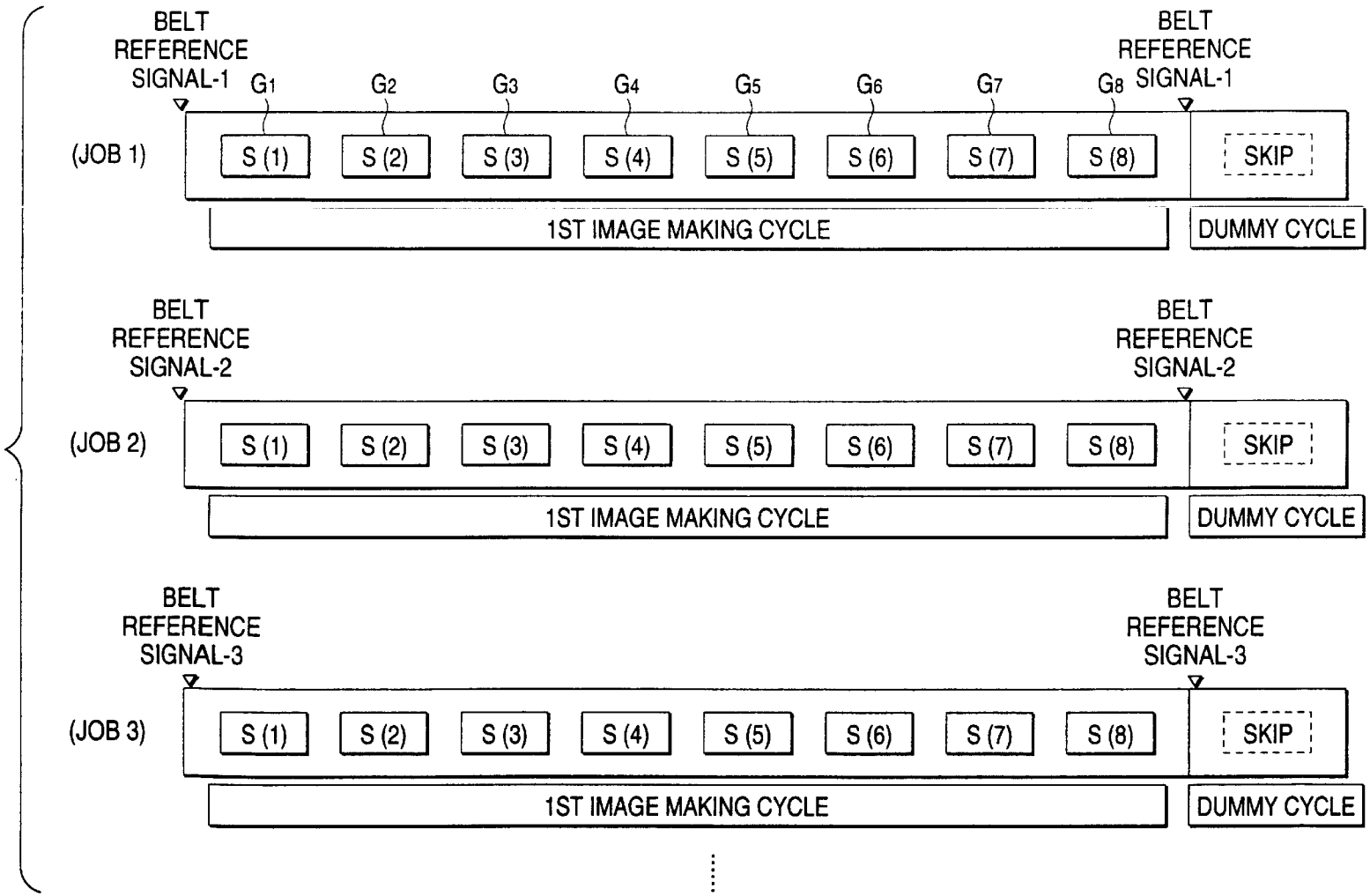
FIG. 29 is a schematic diagram showing a process covering plural jobs (simplex mode) according to the embodiment 6.

When we consider an example case in which three job commands (job 1, job 2, job 3) are received as shown in FIG. 29, the image making controller 100 performs an image making cycle (first image making cycle) on the job 1 according to, for example, the belt reference signal-1 and the timing signals based on the belt reference signal-1 (in this example, seven timing signals are generated for the subsequent seven image carrying regions) and then carries out the reference signal change processing similar to the one shown in FIG. 6.

The reference signal change processing according to this embodiment, as shown in FIG. 29, performs a dummy cycle in which the intermediate transfer belt 20 is rotated through one eighth turn to skip, for example, the leading image carrying region to count up the detection signal from the mark sensor 92 by one. In this state, the belt motor (not shown) is stopped.

Next, the image making controller 100 performs the image making cycle on the job 2 (first image making cycle) according to the belt reference signal-2 and the timing signals based on the belt reference signal-2 (in this example, seven timing signals are generated for the subsequent seven image carrying regions) and then executes the reference signal change processing (by skipping the leading second image carrying region G2) almost similar to the one shown in FIG. 6.

The image making controller 100 then performs the image making cycle on the job 3 (first image making cycle) according to the belt reference signal-3 and the timing signal based on the belt reference signal-3 (in this example, seven timing signals are generated for the subsequent seven image carrying regions), and then performs the reference signal change processing (by skipping the leading third image carrying region G3) almost similar to the one shown in FIG. 6.

After this, these processes are repeated.

While this embodiment switches among the eight belt reference signals, other arrangement may be adopted. For example, four or two of the belt reference signals may be selected to change the image writing position for each two or four image carrying regions.

as to the reference signals for the subsequent image carrying region G, the corresponding belt reference signals may be used. Alternatively, a part of the reference signals may be timing signals based on the belt reference signal corresponding to the leading image carrying region and the remaining part of the reference signals may be the corresponding belt reference signals.

Further, as in the embodiment 3 and 4, the reference signal change processing may be carried out before starting the job.

EMBODIMENT 7

Figure 30:
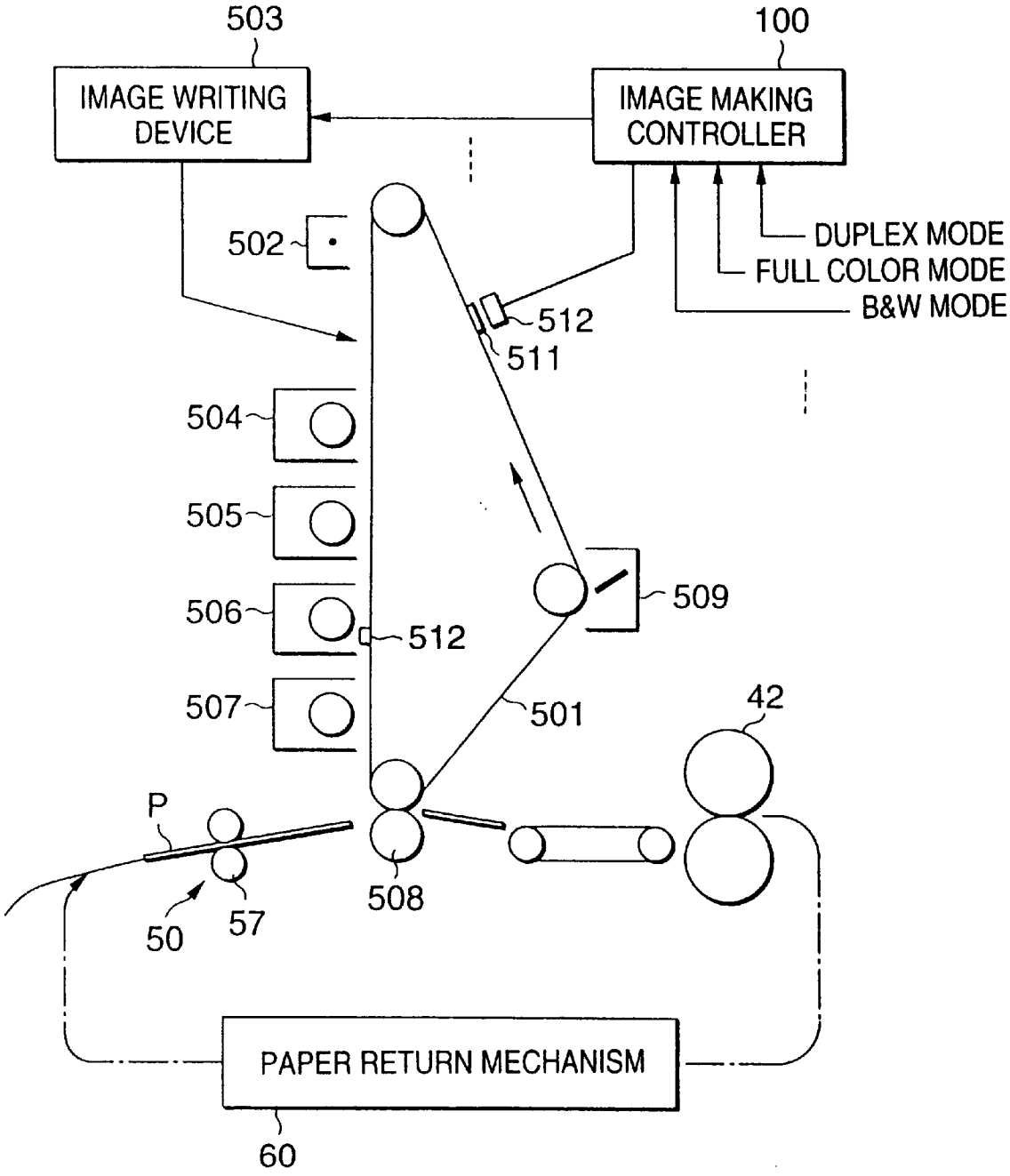
FIG. 30 is an explanatory view showing the outline of an image forming apparatus according to an embodiment 7.

FIG. 30 shows an image forming apparatus according to the embodiment 7.

Unlike the preceding embodiments 1 to 6 of the intermediate transfer type, the duplex image forming apparatus of this embodiment forms the required number of color toner images in layers on a photosensitive belt 501 as a latent image carrier and transfers these color toner images en masse onto the sheet P.

In the figure, reference number 501 represents a photosensitive belt with an insulating surface coat layer; 502 a charger such as scorotron; 503 an image writing device for forming a latent image of each component color on the photosensitive belt 501; 504–507 developers containing yellow (Y), magenta (M), cyan (C) and black (K) toners respectively; 508 a transfer device for transferring multiple toner images formed on the photosensitive belt 501 en masse onto the sheet P; and 509 a belt cleaner for removing residual toners from the photosensitive belt 501 after the transfer process.

In the figure, denoted 42 is a fixing device, 50 a paper feeding system including register rolls 57 to send the sheet P to the transfer position at a predetermined timing, and 60 a paper return mechanism.

In the embodiment, the photosensitive belt 501 has plural image carrying regions (not shown), and reference marks (such as light reflector and transmission hole) 511, 512 for generating reference signals are formed on a part of the photosensitive belt 501 in other than the image carrying regions. A mark sensor 513 is located at a predetermined position spaced from the photosensitive belt 501 and facing the loci of the reference marks 511, 512.

the image making controller 100 receives signals from various selector switches, such as duplex mode, full color mode and B&W (black and white) mode, and a detection signal from the mark sensor 513 and feeds them into the CPU. In response to these signals, the CPU executes an image making program stored in ROM and send out control signals through the I/O port to the photosensitive belt 501, the image writing device 503, other image making devices, the fixing device 42 and the paper feeding system 50, thereby performing the image making processes corresponding to those of the embodiments 1 to 6 on plural the image carrying regions of the photosensitive belt 501.

As described above, because the reference signal for determining the image writing position on the image carrier is changed for each job, the invention can, without lowering the productivity, minimize local degradation of the image carrier and effectively prevent image defects due to resistance reduction and adhesion of release agent.

What is claimed is:

1. An image forming apparatus comprising:

an image making unit that has an image carrier with a plurality of image carrying regions, and causes the image carrying regions on the image carrier to carry and then to transfer the images onto a sheet in a series of image making cycles; and an image making controller that controls the image making unit according to job commands for making images, wherein the image making controller includes a reference signal changing circuit that changes a reference signal for each job and the reference signal determines which of the image carrying regions on the image carrier should be an image writing position.

2. The image forming apparatus according to claim 1, wherein the reference signal changing circuit changes the reference signal during a period from the end of each job to the stopping of the apparatus.

3. The image forming apparatus according to claim 2, wherein the reference signal changing circuit, during the period from the end of each job to the stopping of the apparatus, executes a dummy cycle and, when the dummy cycle in finished, starts an image making cycle on the next job by using a reference signal corresponding to a position downstream of and closest to the dummy cycle with respect to the direction of movement of the image carrier.

4. The image forming apparatus according to claim 1, wherein the reference signal changing circuit changes the reference signal during a period from the start of the apparatus to the start of a job.

5. The image forming apparatus according to claim 4, wherein the reference signal changing circuit, during the period from the start of the apparatus to the start of a job, executes a dummy cycle and, when the dummy cycle is finished, starts an image making cycle on the job by using a reference signal corresponding to a position downstream of and closest to the dummy cycle with respect to the direction of movement of the image carrier.

6. The image forming apparatus according to claim 1, wherein the reference signal changing circuit comprises:

a reference signal generating circuit that generates a plurality of reference signals each representing an image writing position to be set on the image carrier; and a reference signal selecting circuit that switches among the plurality of reference signals generated by the reference signal generating circuit to select one of the reference signals.

7. The image forming apparatus according to claim 6, wherein the reference signal generating circuit generates the reference signals by reading a plurality of reference marks corresponding to all or a part of the plurality of image carrying regions on the image carrier.

8. The image forming apparatus according to claim 6, wherein the reference signal selecting circuit counts all reference signals generated during a period from the start of the apparatus to the stopping of the apparatus and, based on a count value of the reference signals, selects the reference signal for the next job.

9. The image forming apparatus according to claim 1 which performs an image making cycle for causing the plurality of image carrying regions on the image carrier to carry a plurality of images, wherein the image making controller uses a reference signal corresponding to a first image carrying region to generate an image on the first image carrying region and, to generate images on the subsequent image carrying regions, uses as reference signals timing signals produced by a timer based on the reference signal corresponding to the first image carrying region.

10. The image forming apparatus according to claim 1 which performs an image making cycle for causing the plurality of image carrying regions on the image carrier to carry a plurality of image, wherein, to generate images on a plurality of image carrying regions, the image making controller uses reference signals corresponding to the respective image carrying regions.

11. The image forming apparatus according to claim 1, wherein the reference signal changing circuit changes the reference signal under the condition that the image making unit has selected a mode of forming a color image.

12. The image forming apparatus according to claim 1, wherein the reference signal changing circuit changes the reference signal under the condition that the image making unit has selected a mode of forming a duplex image.

13. The image forming apparatus according to claim 1, wherein the reference signal changing circuit changes the reference signal under the condition that the image making unit has selected a mode of forming a color duplex image.

14. The image forming apparatus according to claim 1, wherein the image carrier comprises:

an image forming and carrying body on which an image is formed and carried; and an intermediate transfer body disposed to face the image forming and carrying body, the intermediate transfer body having a plurality of image carrying regions.

15. An image forming apparatus comprising:

an image making unit that causes image carrying regions on an image carrier to carry images and then to transfer the images onto a sheet in a series of image making cycles; and an image making controller that controls the image making unit according to job commands;

wherein the image making controller comprises a reference signal changing circuit that changes a reference signal for each job, and the reference signal determines an image writing position on the image carrier.

* * * * *